US010647455B2

(12) United States Patent
Shigeyama et al.

(10) Patent No.: US 10,647,455 B2
(45) Date of Patent: May 12, 2020

(54) TABLET PACKAGING DEVICE

(71) Applicant: YUYAMA MFG. CO., LTD., Osaka (JP)

(72) Inventors: Yasuhiro Shigeyama, Osaka (JP); Takashi Iwatani, Osaka (JP)

(73) Assignee: YUYAMA MFG. CO., LTD., Osaka (JP)

( * ) Notice: Subject to any disclaimer, the term of this patent is extended or adjusted under 35 U.S.C. 154(b) by 529 days.

(21) Appl. No.: 15/147,352

(22) Filed: May 5, 2016

(65) Prior Publication Data

US 2016/0244192 A1 Aug. 25, 2016

Related U.S. Application Data

(63) Continuation of application No. 13/847,279, filed on Mar. 19, 2013, now Pat. No. 9,428,288, which is a (Continued)

(30) Foreign Application Priority Data

Nov. 26, 2010 (JP) ..... 2010-263559

(51) Int. Cl.
*B65B 5/10* (2006.01)
*A61J 7/00* (2006.01)
(Continued)

(52) U.S. Cl.
CPC ..... *B65B 5/103* (2013.01); *A61J 7/0069* (2013.01); *A61J 7/0076* (2013.01); *B65B 35/32* (2013.01);
(Continued)

(58) Field of Classification Search
None
See application file for complete search history.

(56) References Cited

U.S. PATENT DOCUMENTS 3,464,180 A 9/1969 Bond
4,751,184 A * 6/1988 Higo ..... G01N 35/02 422/65
(Continued)

FOREIGN PATENT DOCUMENTS

JP 05-170201 A 7/1993
JP 07-010102 A 1/1995
(Continued)

OTHER PUBLICATIONS

English translation and the PCT International Search Report in Japanese language dated Dec. 20, 2011 which was issued in a related PCT International Application No. PCT/JP2011/077179 (5 pages).

*Primary Examiner* — Michelle Lopez
*Assistant Examiner* — Chinyere J Rushing-Tucker
(74) *Attorney, Agent, or Firm* — Robert P. Michal, Esq.; Carter, DeLuca & Farrell LLP

(57) ABSTRACT

A packaging section of a tablet packaging device includes: a placement base of a tray; a drawer storing the placement bas; a carrier provided with compartments corresponding to the storage concave portions of the tray; a drive device of the carrier; a shutter opening/closing; a bottom of the carrier; and an opening/closing device of the shutter. The drive device performs a step of defining a tablet discharge position on the tray as an original position and returning to the original position through a tablet reception start position and a tablet reception end position which are set below a discharge opening. A step of sequentially moving each compartment of the carrier below the discharge opening from the tablet reception start position to the tablet reception end position during the step to receive one tray of tablets is performed. When the carrier returns to the discharge position, the shutter is opened.

7 Claims, 20 Drawing Sheets

Related U.S. Application Data continuation of application No. PCT/JP2011/077179, filed on Nov. 25, 2011.

(51) Int. Cl.

| | |
|---|---|
| ***B65B 35/32*** | (2006.01) |
| ***B65B 57/10*** | (2006.01) |
| ***B65B 65/08*** | (2006.01) |
| *A61J 1/03* | (2006.01) |
| *A61J 7/04* | (2006.01) |

(52) U.S. Cl.

CPC ..... *B65B 57/10* (2013.01); *B65B 65/08* (2013.01); *A61J 1/03* (2013.01); *A61J 7/04* (2013.01)

(56) References Cited

U.S. PATENT DOCUMENTS

| | | | | |
|---|---|---|---|---|
| 5,329,749 | A | 7/1994 | Yamamoto et al. | |
| 5,481,855 | A | 1/1996 | Yuyama | |
| 5,852,911 | A * | 12/1998 | Yuyama | B65B 35/04 53/168 |
| 6,116,461 | A * | 9/2000 | Broadfield | A61G 12/001 206/443 |
| 7,389,632 | B2 | 6/2008 | Seiffert et al. | |
| 7,587,878 | B2 | 9/2009 | Kim | |
| 2003/0062378 | A1 | 4/2003 | Bartholomew et al. | |
| 2003/0074868 | A1 * | 4/2003 | Yasuoka | B65B 5/103 53/493 |
| 2004/0000354 | A1 | 1/2004 | Peterson | |
| 2004/0158349 | A1 * | 8/2004 | Bonney | G16H 10/60 700/231 |
| 2005/0061825 | A1 * | 3/2005 | Willoughby | B65D 75/42 221/2 |
| 2007/0062156 | A1 * | 3/2007 | Kim | B65B 5/103 53/131.5 |
| 2007/0084150 | A1 * | 4/2007 | Siegel | B65B 5/103 53/475 |
| 2008/0148685 | A1 * | 6/2008 | Kim | B65B 5/103 53/77 |
| 2008/0271414 | A1 | 11/2008 | Yuyama et al. | |
| 2009/0014458 | A1 * | 1/2009 | Heffron | A61G 12/001 221/2 |
| 2009/0044489 | A1 | 2/2009 | Siegel | |
| 2009/0133362 | A1 | 5/2009 | Benetele et al. | |
| 2009/0235614 | A1 | 9/2009 | Yuyama et al. | |
| 2009/0320721 | A1 | 12/2009 | Knoth | |
| 2009/0321472 | A1 | 12/2009 | Knoth | |
| 2010/0121486 | A1 * | 5/2010 | Yuyama | G07F 11/44 700/227 |
| 2010/0175782 | A1 | 7/2010 | Yuyama et al. | |
| 2011/0278319 | A1 | 11/2011 | Knoth | |
| 2014/0358278 | A1 | 12/2014 | Zhang et al. | |

FOREIGN PATENT DOCUMENTS

| | | | |
|---|---|---|---|
| JP | 2001-213401 | A | 8/2001 |
| JP | 2006-232351 | A | 9/2006 |
| JP | 2009-096557 | A | 5/2009 |
| JP | 2010-155089 | A | 7/2010 |
| WO | WO 2006/090761 | A1 | 8/2006 |
| WO | WO 2009/023632 | A1 | 2/2009 |

* cited by examiner

TABLET PACKAGING DEVICE

CROSS-REFERENCE TO RELATED APPLICATIONS

This is a Continuation of U.S. patent application Ser. No. 13/847,279 filed Mar. 19, 2013 which is a continuation of PCT International Application PCT/JP2011/077179 filed Nov. 25, 2011, which in turn claims the benefit of priority under 35 U.S.C. § 119 of Japanese Patent Application No. JP2010-263559 filed Nov. 26, 2010, the entire disclosure of each of which is incorporated herein by reference.

TECHNICAL FIELD

The present invention relates to a tablet packaging device for packaging prescribed daily doses of tablets in a blister packaging tray (called a "tray" hereafter).

BACKGROUND ART

Tablet packaging devices are known (such as that disclosed in U.S. Pat. No. 3,506,462) which automatically dispense and package prescribed tablets in the storage concavities of a tray having storage concavities divided into seven rows and four columns. The tray is designed so that tablets packaged in accordance with a dosing frequency of four doses per day are stored in the respective storage concavities of one row and so that one week's worth of tablets can be stored in all seven rows.

In the conventional tablet packaging device described above, a scraper unit is provided on a belt conveyor for carrying the tray so as to be able to freely advance and retreat in the transverse direction of the conveyor. The tray is installed and carried so that the direction of the rows of the storage concavities faces the width direction of the conveyor and so that the direction of the columns faces the advancing direction of the conveyor. The scraper unit is provided with four compartments corresponding to the four storage concavities of each row of the tray, and a scraper (scraping instrument) is respectively provided in each compartment.

The scraper unit described above sequentially moves the bottom of a tablet discharge hopper to each of the four compartments so as to receive tablets, and in a state in which the tablets have been dispensed into all four of the compartments, the scraper unit advances over the conveyor so that each compartment coincides with an opening in the upper part of each of the four storage concavities of each row of the tray. A shutter of each compartment of the scraper unit is opened in a state in which there is vertical coincidence, and the tablets on the inside are simultaneously scraped out by the operation of the scraper and individually discharged into the four concavities of the tray.

The scraper unit described above repeats seven cycles of sequentially executing the reception of tablets into the four compartments, the opening and closing of the shutter, and the scraping of the tablets by the scraper. Meanwhile, the belt conveyor repeats seven cycles of advancing and stopping for each row of the tray, and the discharge and reception of tablets into the storage concavities are thus completed. Once tablets have been stored in all of the storage concavities, the tray is carried out by the belt conveyor and retrieved on the outside from the discharge part so as to complete the packaging process.

SUMMARY OF THE INVENTION

In the conventional tablet packaging device described above, the process of operating the scraper unit for each tray entails repeating seven cycles of the reception of tablets into each of the four compartments, the opening of the shutter, and scraping by the scraper, which leads to the problem that the packaging efficiency is low.

In addition, while the tray is carried to the discharge part after receiving tablets from the scraper unit, the belt conveyor repeatedly advances and stops with short, quick steps. This leads to the risk that the tablets may depart from the storage concavities or become chipped due to vibration, and this risk increases as the carrying speed increases. If the storage concavities have shallow bases or if the shapes of the storage concavities are concave spherical surfaces, the risk of flying out increases further and becomes a factor leading to packaging errors.

Further, since a shutter and a scraper are provided for each of the four compartments of the scraper unit described above, there is also the problem that the structure is complex.

Therefore, a problem of the present invention is to provide a structurally simplified tablet packaging device which has high packaging efficiency and few packaging errors by receiving all of the tablets for a single tray with a single carrier, moving the carrier onto a tray standing by at a discharge position, and collectively discharging the tablets into all of the storage concavities of the tray.

In addition, there must be a prescribed gap between the tray and the carrier moving within the plane of the upper part thereof so as to prevent the free movement of the carrier. On the other hand, if there is a gap between the tray and the carrier when discharging tablets to the tray side from the carrier after receiving the tablets, there is a risk that the tablets may depart to the outside from the gap.

The present invention ensures that tablets can be transferred reliably to the tray side by eliminating the gap described above when discharging tablets from the carrier to the tray. In this case, the risk that the tray or carrier may be damaged by the impact when the tray is pressed into the base of the carrier is eliminated.

The carrier is provided with multiple compartments coinciding with the storage concavities of the tray, and when transferring tablets to the tray, a structure in which the open bases of the compartments are collectively opened and closed by a single shutter is employed. However, foreign matter, such as chips of tablets, sometimes adheres to the shutter, and there is a concern that the foreign matter may be discharged to the tray side together with the tablets.

The present invention ensures that no foreign matter is discharged into the storage concavities of the tray by removing any foreign matter adhering to the shutter of the carrier in advance.

Further, automatically checking as to whether tablets have been received in all of the compartments of the carrier and have been reliably stored in each of the compartments before being transferred to the tray is employed. If there is any insufficiency, the tablets are not transferred to the tray, and the carrier is moved to a recovery position so that the tablets are transferred to a recovery tray. In this case, the tablets may bounce off the base of the recovery tray and depart from the recovery tray or become chipped. Therefore, the present invention also prevents the bouncing of tablets in the recovery tray.

In order to solve the problems described above, the present invention is directed to a tablet packaging device in which a packaging part is provided below a discharge opening for tablets discharged in accordance with a prescription. The device includes a tray having a prescribed number of storage concavities divided into a plurality of rows and columns placed on the packaging part; and tablets discharged from the discharge opening are dispensed and stored in the respective storage concavities. The packaging part includes a mounting platform for the tray and a moving device for the mounting platform, a carrier provided with compartments opened at the top and bottom which can coincide with the positions of the storage concavities of the tray and a drive device for the carrier, and a shutter provided on the base of the carrier so as to open and close the compartments and an opening/closing device for the shutter. The moving device of the mounting platform moves the mounting platform between a tray handling position and a standby position concurrently with the timing of movement of the carrier. The drive device of the carrier executes a process of sequentially returning to an original position via a tablet reception starting position and a reception ending position set below the discharge opening. The original position is defined as a discharge position where the carrier is set above the standby position and, during this process, executes a reception process of moving each compartment of the carrier below the discharge opening between the reception starting position and the reception ending position to receive tablets. The opening/closing device of the shutter opens the shutter when the carrier returns to the discharge position from the reception ending position and is closed at all other times.

While executing one cycle of the carrying process, the carrier receives all of the tablets for one tray in all of the compartments. The tablets are then carried onto the tray and are collectively discharged into the storage concavities of the tray corresponding to the compartments as a result of the opening of the shutter. The tray is simply moved between the tray handling position and the standby position by a moving device separate from the drive device of the carrier. However, a timing relationship in which the mounting platform completely moves to the standby position before the carrier returns to the discharge position is required.

It is preferable to use a configuration in which the moving device of the mounting platform consists of a drawer provided so as to be freely drawn into and out of the packaging part. The mounting platform is installed inside the drawer, and the mounting platform is set so as to be in the tray handling position outside the packing part when the drawer is pulled out and in the standby position inside the packaging part when the drawer is pushed in.

It is also possible to use a configuration in which the mounting platform is supported by a vertical moving device. The vertical moving device is operated when receiving tablets from the carrier while in the standby position so as to bring the tray on the mounting platform close to or into contact with the base of the carrier.

Further, it is possible to lighten the impact when the tray on the mounting platform makes contact with the bottom of the carrier by using a configuration in which the vertical moving device is provided with a damper, the free end of which is brought into contact with the base of the mounting platform.

It is also possible to use a configuration in which the drive device of the carrier includes an XY drive mechanism for moving the carrier in an X-direction within the horizontal plane and a Y-direction perpendicular to the X-direction.

Specifically, it is possible to use a configuration in which the XY drive mechanism includes a Y-direction drive motor, an X-direction drive motor, Y-direction drive belts installed at two locations on the left and right sides of the packaging part, a casing supported between the two Y-direction drive belts, and an X-direction drive belt. The X-direction drive motor and the X-direction drive belt are mounted in the casing so that the Y-direction drive belt is driven by the Y-direction drive motor and the X-direction drive belt is driven by the X-direction drive motor. The carrier is connected to an X-direction slider attached to the X-direction drive belt via a bracket provided on the carrier.

It is also possible to use a configuration in which the bracket is detachably engaged with the carrier, and the carrier is detachably connected to the bracket by a locking member.

It is also possible to use a configuration in which, if there is a tablet distribution error in each compartment of the carrier after returning to the discharge position from the reception position, the carrier is moved to a recovery position before the shutter is opened, and the shutter is opened in the recovery position so that all of the tablets inside the compartment are discharged to a recovery tray. It is desirable for a cushion sheet to be laid out on the inside base of the recovery tray.

It is also possible to use a configuration in which a shutter guide member is provided on the base of the carrier. The shutter guide member is provided with holes disposed so as to coincide with the compartments of the carrier. The shutter is interposed between the shutter guide member and the carrier base so as to be freely slidable in the forward and backward directions. An engaging edge is provided on the back end of the shutter.

It is also possible to use a configuration in which the opening/closing mechanism of the shutter includes an opening mechanism and a closing mechanism, wherein the opening mechanism includes a shutter opening/closing motor, shutter opening belts installed in two locations on the left and right sides of the packaging part in the forward and backward directions and configured so as to make the engaging bar engage with the front surface of the engaging edge of the shutter. The closing mechanism is configured so that a contractile spring is attached between the shutter guide member and the shutter.

It is also possible to use a configuration in which the contractile spring includes a wound spring exhibiting a spring force in the winding direction, wherein the spring case is fixed to the shutter guide member. The free end of the spring in the contracted state is connected to a part of the shutter in the closed state. The spring is drawn out when the shutter is opened by the opening mechanism, and the engaging bar is contracted to the wound state so as to close the shutter when the engaging bar returns to the original position.

It is also possible to use a configuration in which a brush is provided on the back end of the carrier so as to make contact with the upper surface of the shutter. A foreign matter discharge slit is provided in the shutter guide member along the brush. The front end edge of the shutter is provided with a notch part of an area similar to the entire width thereof. A portion along the back end edge is provided with a shutter slit of a length similar to the entire width thereof, and the positional relationships of the foreign matter discharge slit, the notch part, and the shutter slit are set so that the notch part coincides with the foreign matter discharge slit when the shutter is fully open, and so that the shutter slit coincides with the foreign matter discharge slit when the shutter is fully closed.

The tablet packaging device of the present invention is able to store prescribed tablets in all of the storage concavities with one cycle of the carrying process of the carrier.

In addition, while one cycle is being executed, the tray is at rest in the standby position, and the tray is moved to the tray handling position by the moving device of the mounting platform after the tablets are stored. This movement may be relatively slow, since the movement need only be completed during the process of one cycle of the carrier. Therefore, the tablets stored in the storage concavities of the tray are subjected to little vibration, and problems such as departure to the outside of the tray during carrying is eliminated.

By providing the vertical moving device for bringing the mounting platform of the tray close to the base of the carrier, it is possible to eliminate problems in which tablets depart to the outside when discharging tablets to the tray side while preventing the inhibition of the movement of the carrier during normal operation by establishing a sufficient gap between the carrier and the tray.

By providing a damper on the vertical moving device, it is possible to eliminate the problem in which the tray traumatically strikes the base of the carrier. Even when a plurality of trays are stacked on the mounting platform, all of the trays can be pressed into the base of the carrier.

Providing a brush on the shutter insertion port of the carrier makes it possible to clean the upper surface when the shutter is opened and closed, and foreign matter, such as chips of tablets, can be prevented from being discharged to the tray.

Further, by laying a cushion sheet over the base of the recovery tray, it is possible to prevent the occurrence of departure from the recovery tray or tablet chipping due to the ricocheting of the recovered tablets.

The carrier can be removed from the device by operating the locking member so that the carrier can be removed to the outside for cleaning or the like.

DETAILED DESCRIPTION

A tablet packaging device of an embodiment of the present invention will be described hereinafter based on the attached drawings.

Figure 1:
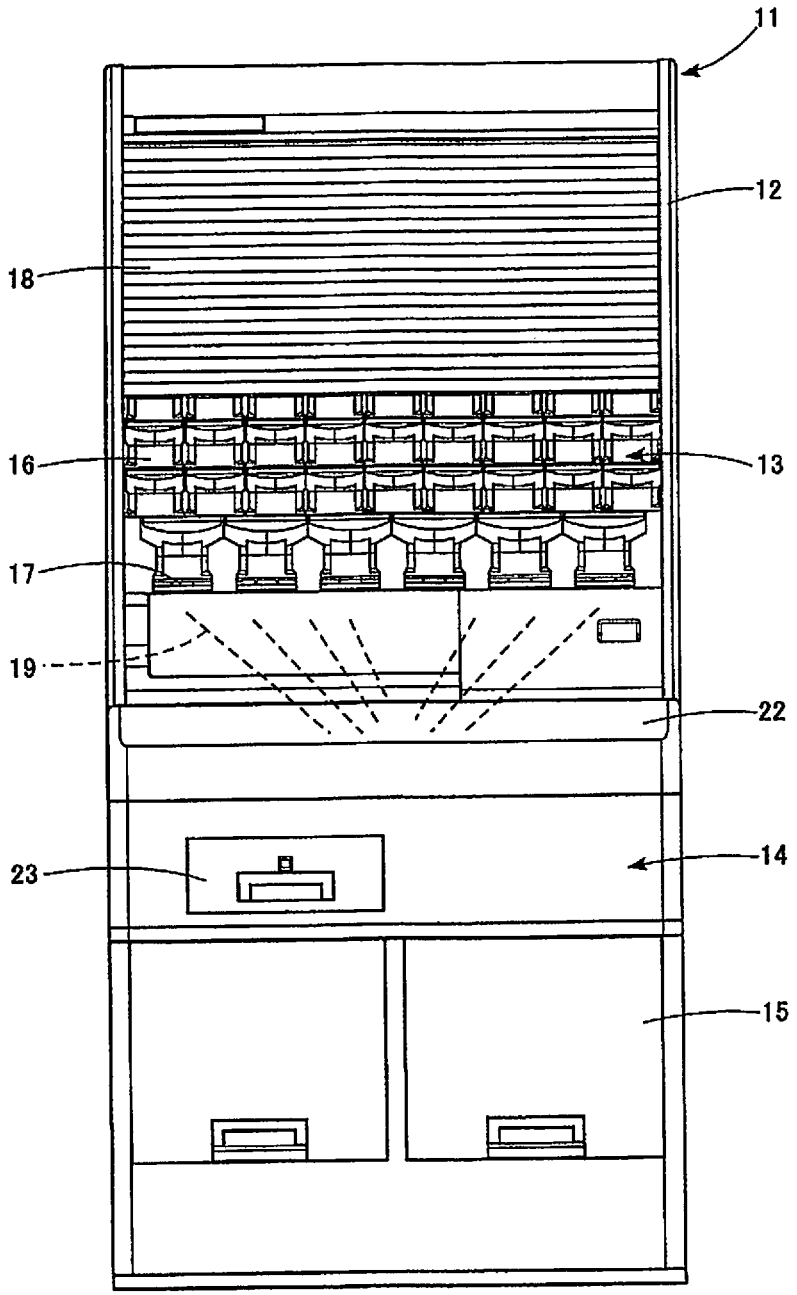
FIG. 1 is a front view of the tablet packaging device of an embodiment.
Figure 2:
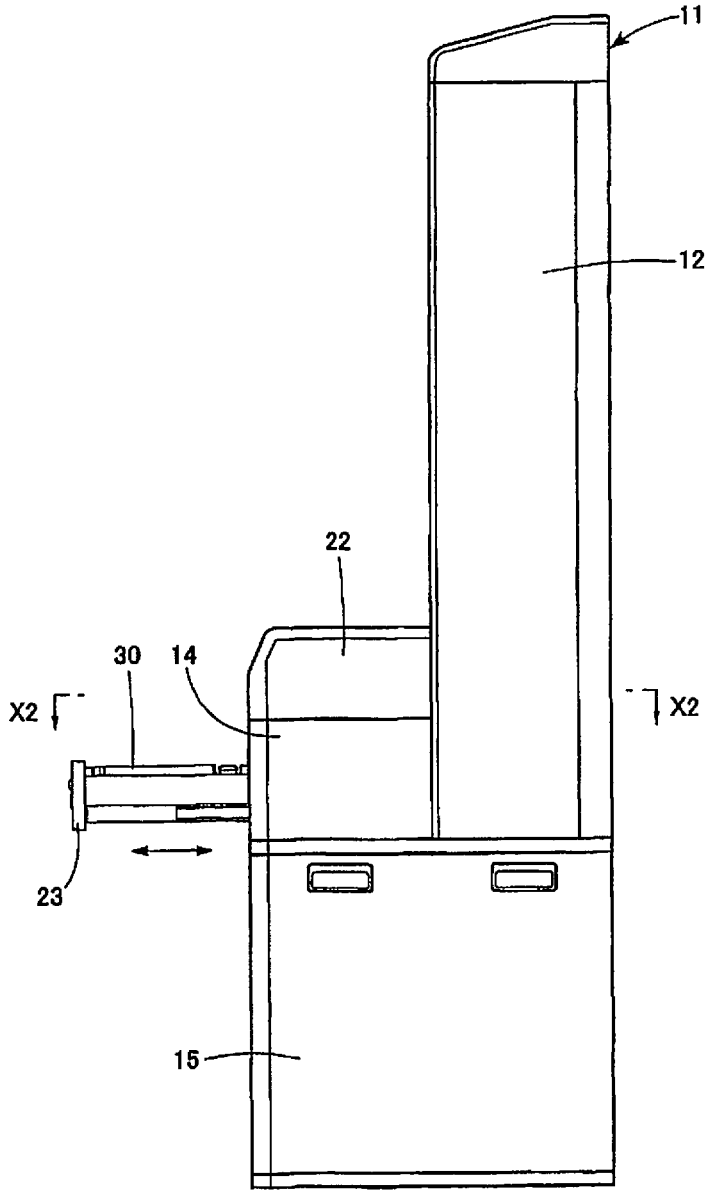
FIG. 2 is a side view of FIG. 1.

In a tablet packaging device 11 shown in FIG. 1, a table storage part 13 is provided on the upper half of a frame 12, wherein a packaging part 14 (see FIG. 2) protruding forward from the upper half is provided on the lower half, and a storage part 15 such as an empty tray is provided below [the packaging part 14]. Multiple tablet cassettes 16 are stored in the table storage part 13 in a multi-stage configuration, and a tablet feeder 17 is respectively installed below each tablet cassette 16. The table storage part 13 is opened and closed in the vertical direction by a slatted shutter 18.

A tablet discharge chute 19 is provided below the tablet feeders 17. A reception port 20 (see FIG. 5) is provided so as to approach the lower end of the tablet discharge chute 19, and a downward-facing discharge port 21 connected to the reception port 20 is provided above the packaging part 14. Daily doses of prescribed tablets—for example, one week's worth of tablets at a frequency of four doses per day or five days' worth of tablets at a frequency of three doses per day—are intermittently discharged from the discharge port 21 for each cycle of a carrying process described below.

In the tablet packaging device 11, tablets discharged from the discharge port 21 are ultimately stored in a tray 24 shown in FIGS. 3A to 4C. Therefore, this tray 24 will be described next.

Figure 3A:
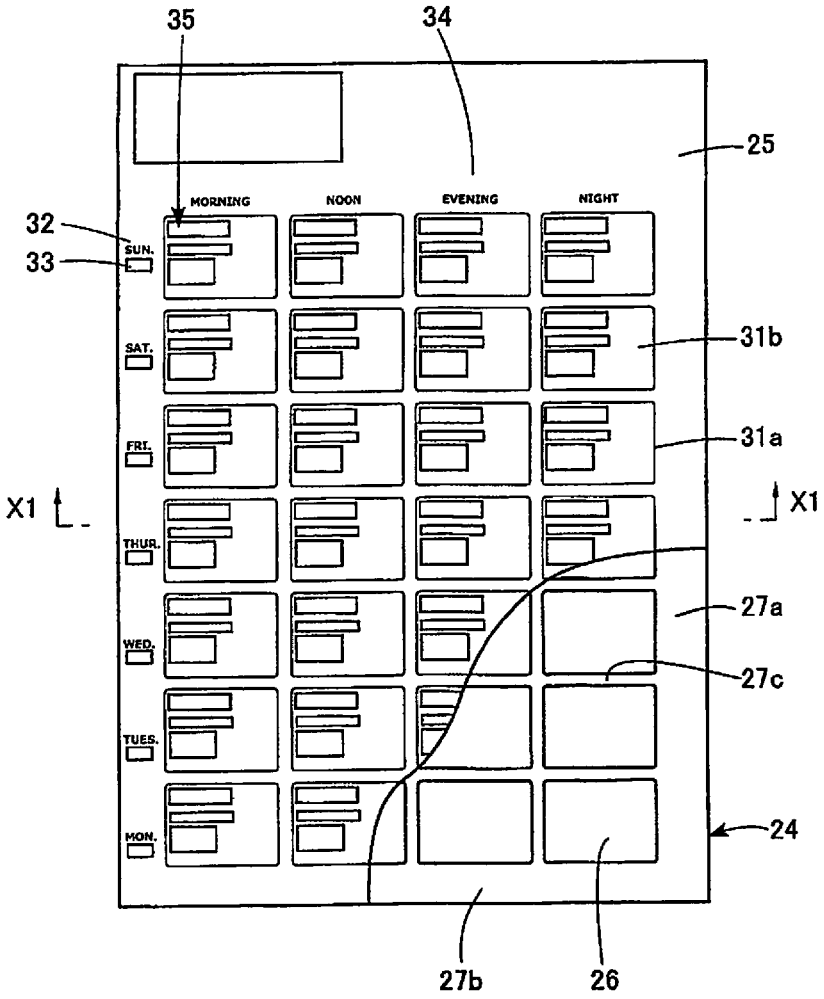
FIG. 3A is a partially cut out plan view of a state in which a lid is attached to the tray.
Figure 3B:
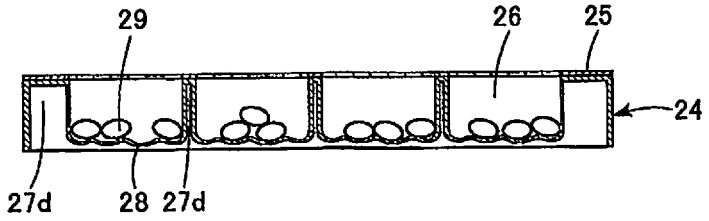
FIG. 3B is a cross-sectional view along line X1-X1 in FIG. 3A.

FIGS. 3A and 3B show a state in which a lid sheet 25 is attached to the open surface of the tray 24. The tray 24 has storage concavities 26 divided into a matrix comprising seven rows and four columns. A side wall 27*a* opposing the long edge side of the tray 24, a side wall 27*b* opposing the short edge side, and a dividing wall 27*c* for dividing the space therebetween into seven rows and four columns are formed to the same height so as to intersect in a grid pattern, whereby concavities 26 with uniform square shapes are formed.

The wall thickness portions on the base side of the side walls 27*a* and 27*b* and the dividing wall 27*c* are removed by grooves 27*d* so as to form a wall thickness capable of supporting a constant strength. The wall thickness of the base of the storage concavities 26 is formed as a single thin layer and molded so as to have multiple creases 28 of irregular shapes. Since the base is thin and has multiple creases 28, it is possible to exhibit a buffering effect for tablets 29 stored therein, and it may be deformed into a mountain shape by pressing away from the base (see the double-dotted/dashed line in FIG. 4C) so that the tablets 29 on the inside are easy to retrieve.

Figure 4A:
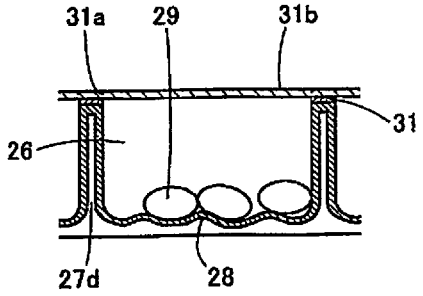
FIG. 4A is a partially enlarged cross-sectional view of FIG. 3A.

The lid sheet 25 is a paper sheet of a size matching the entire surface of the open side of the tray 24 and is attached with an adhesive 31 at the portions of the side wall 27*a* on the long edge side, the side wall 27*b* on the short edge side, and the dividing wall 27*c* (see FIG. 4A). A breakout part 31*b* enclosed by a break line 31*a* established by half cuts or perforations of a square shape matching the size of the storage concavities 26 is formed on the lid sheet 25 (see FIG. 4A).

A day-of-the-week display 32 and a corresponding date display 33 are provided in the respective margins of the seven rows in the vertical direction of the breakout part 31*b*. In addition, a dosing time display 34 from "morning" to "before bed" or the like and other displays are provided in the margins of the four rows in the horizontal direction. A prescription display 35 such as the name of the patient, the dosing times, and the tablet name and quantity is also provided on the breakout part 31*b*. In the case illustrated, the display shows that one week's worth of tablets at frequency of four doses per day are housed, and different quantities such as five days' worth of tablets at a frequency of three doses per day may be stored depending on the prescription.

Figure 4B:
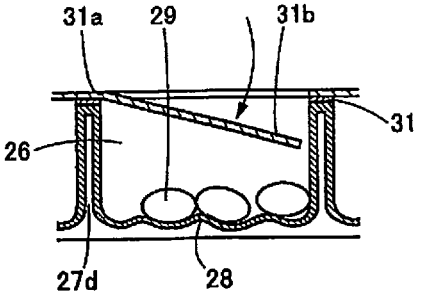
FIG. 4B is a partially enlarged cross-sectional view of FIG. 3A at the time of use.
Figure 4C:
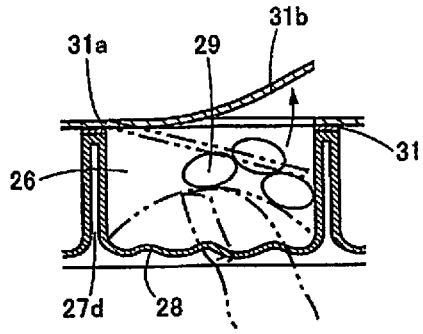
FIG. 4C is a partially enlarged cross-sectional view of FIG. 3A in another state at the time of use.

The patient breaks the appropriate breakout part 31*b* along the break line 31*a* by pressing the breakout part 31*b* with the fingertips at the time of each of the four doses of the day in question (see FIG. 4B). The breakout part 31*b* is pressed into the storage concavity 26 and is therefore retrieved together with the tablets 29 by pinching with the fingertips or pressing the base upward with the fingertips (see FIG. 4C).

The breakout part 31*b* is broken/removed in step with the action of retrieving the tablets 29, and the storage concavity 26 is opened. Accordingly, it can be easily checked whether any doses have been forgotten by simply distinguishing whether the storage concavity 26 has been opened.

Figure 5:
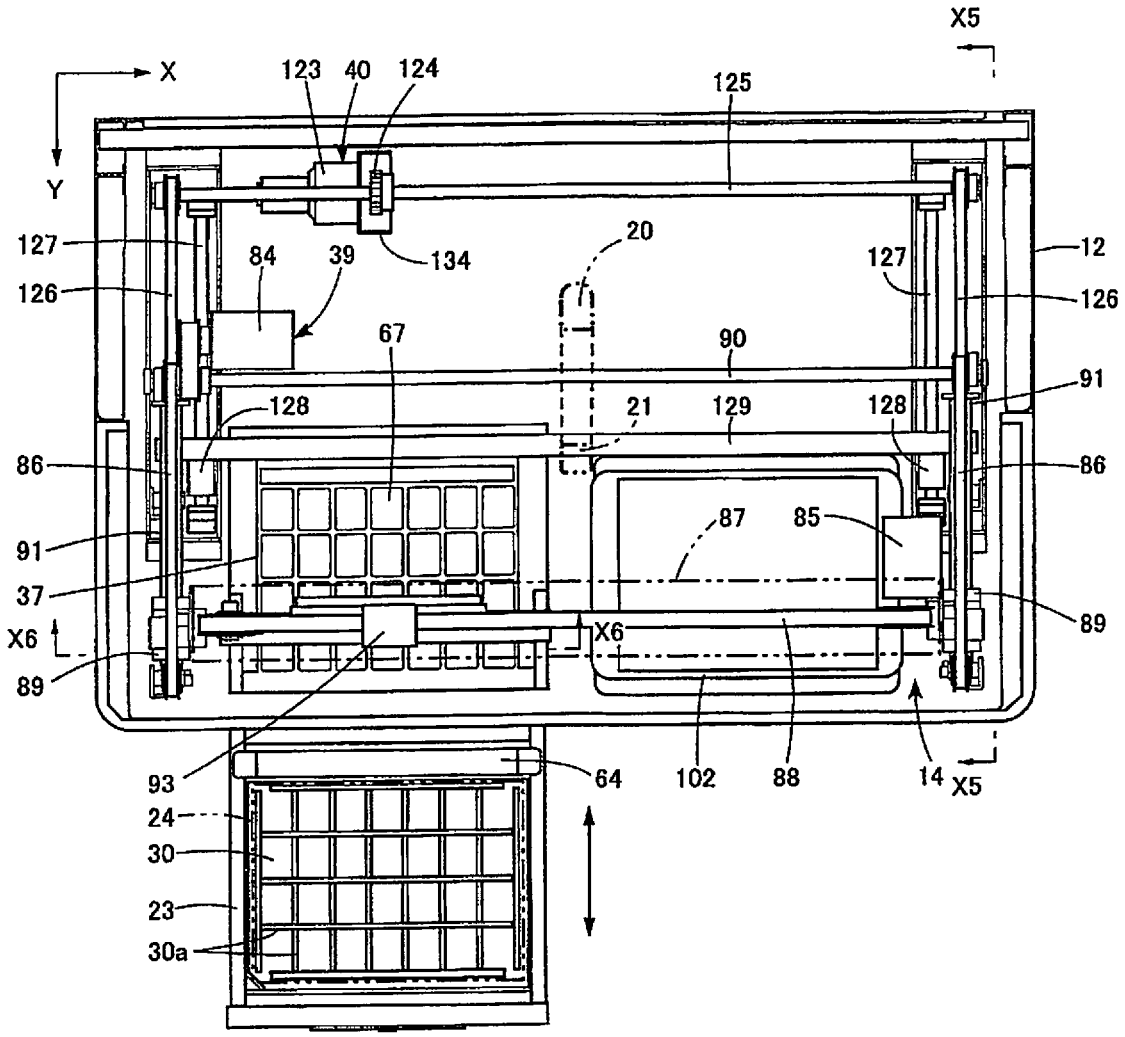
FIG. 5 is a cross-sectional view along line X2-X2 in a state in which the lid of FIG. 2 is removed.

Next, the packaging part 14 shown in FIG. 5 will be described in detail. The packaging part 14 is ordinarily covered with a cover lid 22 (see FIG. 2) so that the inside can be observed through an observation window. The packaging part 14 is opened when the cover lid 22 is removed. FIG. 5 shows a transverse view in which the cover lid 22 is removed and the upper half of the frame 12 is cut out.

The packaging part 14 is provided with a drawer 23 which can be freely pulled forward and pushed into the packaging part 14, and a mounting platform 30 of the tray 24 is installed inside the drawer 23. The drawer 23 constitutes the "moving device for the mounting platform." In the case illustrated, the drawer 23 is pulled out and pushed in manually (see the two-headed arrows in FIGS. 2 and 5), but the drawer 23 may also be driven automatically.

As shown in FIG. 5, the main components of the packaging part 14 are the drawer 23, the mounting platform 30 installed inside the drawer 23, a carrier 37 which receives tablets 29 discharged from the discharge port 21 and carries the tablets 29 to the upper part of the tray 24 on the mounting platform 30, a shutter 38 for opening and closing the base of the carrier 37 (see FIG. 9B), a drive device 39 for moving the carrier 37 to a prescribed position within the plane, and an opening/closing device 40 for the shutter 38. These components will be described in detail hereinafter.

A vertical moving device 41 (see FIGS. 6A and 7) is provided inside the drawer 23, and the mounting platform 30 is installed on the vertical moving device 41. The vertical moving device 41 includes a vertical movement motor 42 (see FIG. 7), two rotary shafts 44 which are disposed along the front and back ends of the drawer 23 and are interlocked with one another by a belt 43, eccentric cams 45 attached to both ends of each rotary shaft 44, and cam followers 46 (see FIG. 6A) provided at eccentric positions on the outside surfaces of each eccentric cam 45.

The cam followers 46 are provided at the same phase positions in the rotational direction for all of the eccentric cams 45. All of the cam followers 46 maintain the same phase—that is, the cam followers 46 collectively rotate while maintaining the same height—in response to the rotation of the motor 42.

A bearing 47 for supporting the rotary shaft 44 disposed on the back end side of the drawer 23 (see FIG. 7) is attached to a fixed bracket plate 48, and a bearing 47 of the rotary shaft 44 disposed on the front end side is attached to a movable bracket plate 49. Both bracket plates 48 and 49 overlap one another in a plane, and fixing screws 52 are inserted into long holes 51 provided with long profiles in the cross direction on the overlapping portions.

Adjustment plates 53 and 54 provided on the respective bracket plates 48 and 49 are made to oppose one another. The legs of adjustment bolts 55 and 56 screwed into each of the adjustment plates 53 and 54 from opposite sides are pressed against the other of the adjustment plates 53 and 54, and the movable bracket plate 49 is moved forward and backward so as to adjust the space between the front and back rotary shafts 44.

Guide pins 58 fixed facing downward are respectively provided at the four corners of the base of the mounting platform 30, and sleeves 61 are made to engage with the guide pins 58 so as to be slidable with a constant stroke in the vertical direction. Contact plates 59 are provided integrally with the lower ends of the sleeves 61. Anti-slip members 62 are provided on the lower ends of the guide pins 58 so as to prevent the guide pins 58 from slipping downward from the sleeves 61.

The contact plates 59 of the sleeves 61 rest on the cam followers 46, and when the cam followers 46 are in the lowest position, the mounting platform 30 rests on mounting platform supporting members 57 provided at two locations on the left and right sides of the base of the drawer 23. At this time, there is a gap between the sleeves 61 and the mounting platform 30, and as a result, there is also a gap x between the tray 24 and the base of the carrier 37 (see the left half of FIG. 6A). Due to the presence of this gap x, the carrier 37 can move freely within the plane of its height without making contact with the tray 24.

Figure 6A:
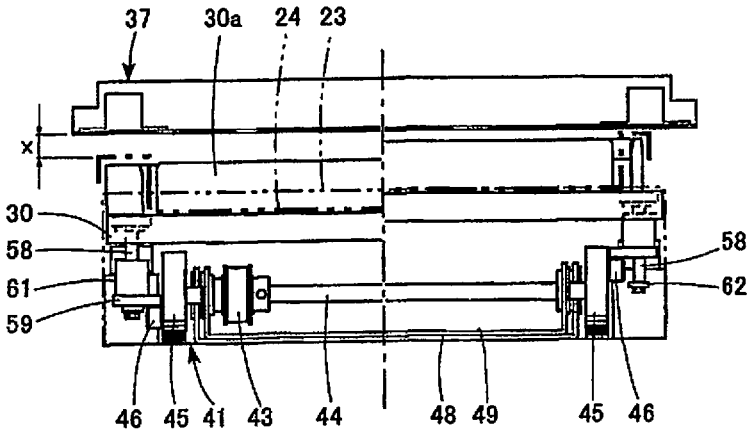
FIG. 6A is an explanatory diagram from the perspective of the front of the drawer showing the positional relationship of the mounting platform and the carrier in the standby state.
Figure 6B:
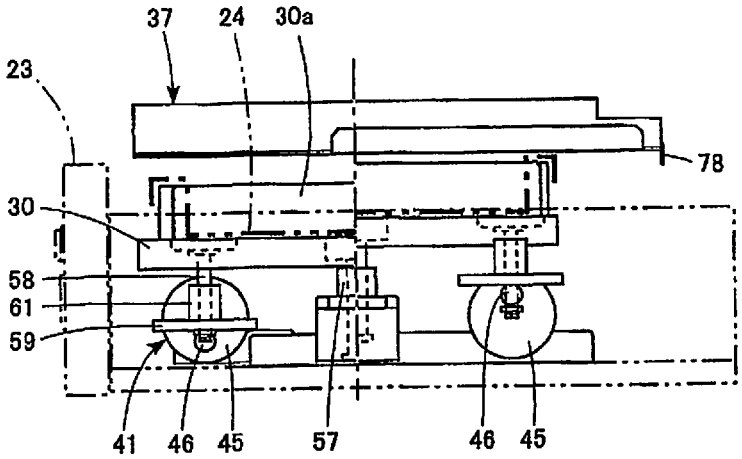
FIG. 6B is an explanatory diagram from the perspective of the side of the drawer showing the positional relationship of the mounting platform and the carrier in the standby state.

When the cam followers 46 reach the highest position, the mounting platform 30 is pressed upward into the sleeves 61, and the gap x is reduced or eliminated so that the tray 24 approaches or makes contact with the base of the carrier 37 (see the right half of FIGS. 6A and 6B).

Figure 6C:
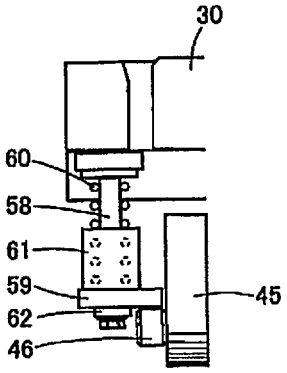
FIG. 6C is a partial side view of FIG. 6B.

At this time, a coil spring 60 constituting a damper is stored in the sleeve 61 (see FIG. 6C), and the free upper end of the coil spring 60 makes contact with the base of the mounting platform 30. As a result, the impact when the tray 24 makes contact with the carrier 37 is lightened.

In order to increase operational efficiency, a plurality of trays 24 may be placed on the mounting platform 30 within a range confined to the gap x and handled so as to move to the next step after simply sequentially removing the trays 24 from the top once the storage of the tablets 29 is complete. In this case as well, all of the plurality of trays 24 may be pressed into the base of the carrier 37 by the compressive elasticity of the coil springs 60.

On top of the on the mounting platform 30, as shown in FIG. 5, tray support ribs 30*a* divided into a matrix comprising seven compartments in the horizontal direction and four compartments in the cross direction are provided so as to correspond to the tray 24. The tray 24 is placed on the tray support ribs 30*a* with an orientation in which the seven divided portions face the left and right directions. At this time, the grooves 27*d* on the back of the side walls 27*a* and 27*b* and the dividing wall 27*c* of the tray 24 are made to engage with the support ribs 30*a* so that the tray 24 is stably supported.

Figure 7:
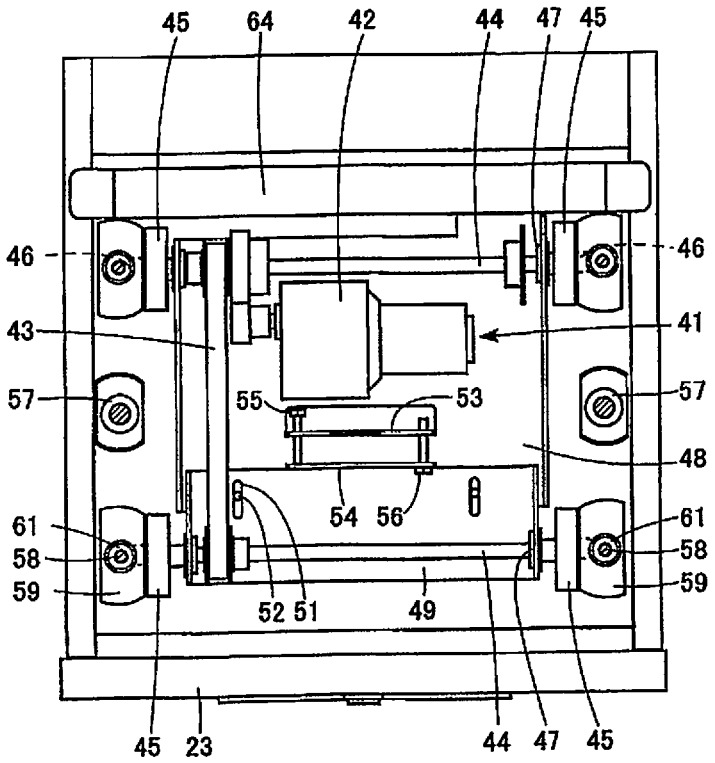
FIG. 7 is a plan view showing the portion of the vertical moving device.

A foreign matter reception tray 64 with a long profile in the horizontal direction is detachably attached to the portion of the drawer 23 at the back end of the tray support ribs 30*a* (see FIGS. 5 and 7). The configuration for collecting foreign matter adhering to the shutter 38 with this foreign matter reception tray 64 will be described in detail below.

Figure 8A:
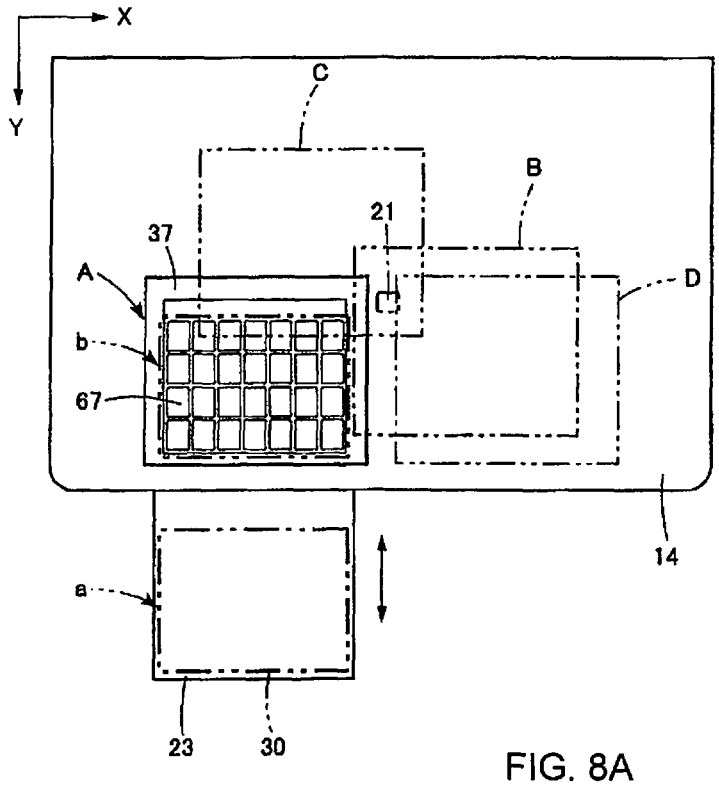
FIG. 8A is a schematic diagram showing the movement positions of the mounting platform and the carrier.

The position of the mounting platform 30 in the state shown in FIG. 5 in which the mounting platform 30 is pulled to the outside of the packaging part 14 by pulling out the drawer 23 is called the tray handling position A (see FIG. 8A). In this tray handling position a, the operator places an empty tray 24 on the mounting platform 30 and removes a tray 24 in which tablets have been stored from the mounting platform 30.

The tray 24 on the mounting platform 30 is placed on the mounting platform 30 in a state in which seven rows from "Monday" to "Sunday" are arranged in the horizontal direction (X-direction) and four columns from "morning" to "before bed" are arranged in the cross direction (Y-direction) by rotating clockwise by 90° from the state shown in FIG. 3A.

FIG. 8A schematically shows the form of the movement of the drawer 23 inside the packaging part 14, the mounting platform 30 provided thereon, and the carrier 37, wherein the horizontal direction is shown as the X-direction and the cross direction is shown as the Y-direction facing the packaging part 14.

The position of the mounting platform 30 when the drawer 23 is pushed into the packaging part 14 is called the standby position b. The amount of movement of the drawer 23 in the cross direction (Y-direction) is set so that the mounting platform 30 is in the tray handling position a outside the packaging part 14 when pulled out and in the standby position b inside the packaging part 14 when pushed in.

As described above, the moving device for the drawer 23—that is, the mounting platform 30—executes a process of manually or automatically moving the mounting platform 30 between the tray handling position a and the standby position b in coincidence with the timing of the movement of the carrier 37.

Next, the carrier 37, the shutter 38 thereof, the drive device 39 of the carrier 37, and the opening/closing device 40 of the shutter 38 will be described.

Figure 8B:
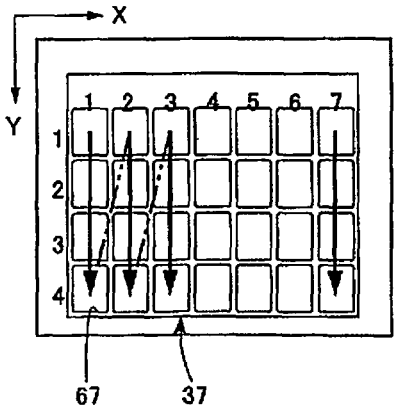
FIG. 8B is a plan view of the carrier.
Figure 9A:
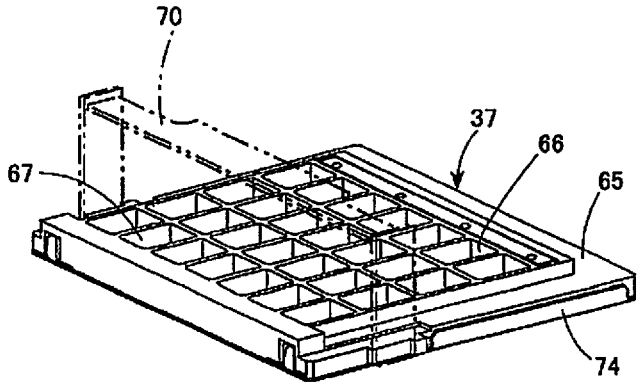
FIG. 9A is a perspective view of the carrier.

As shown in FIG. 9A, the carrier 37 is provided with matrix-shaped dividing walls 66 inside a square frame 65 so as to form compartments 67 divided into seven compartments in the X-direction (horizontal direction) and four compartments in the Y-direction (cross direction). Each compartment 67 is open and has a size coinciding with each storage concavity 26 of the tray 24. For the sake of explanatory convenience, as shown in FIG. 8B, x numbers 1 to 7 and y numbers 1 to 4 are virtually assigned to the X-direction and the Y-direction of the compartments 67, respectively, and the position of each compartment 67 will be described by the coordinate display (x, y).

Figure 9B:
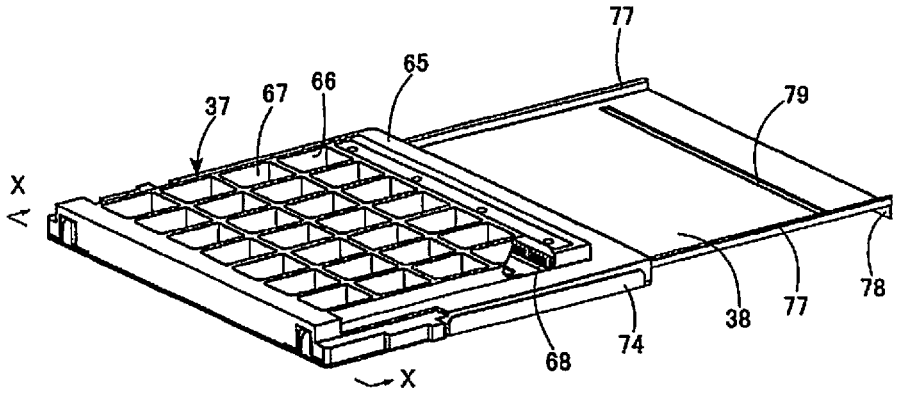
FIG. 9B is a partially cut out perspective view when the shutter is fully open.

A downward-facing brush 68 of a length filling the entire inside surface of the back edge is attached between the inside surface of the back edge of the frame 65 and the compartments 67 (see FIG. 9B). As described below, this brush 68 is used to clean the upper surface of the shutter 38.

In addition, a thin plate-like shutter guide member 71 is fixed to the base of the carrier 37 with a constant gap in the vertical direction. Square holes 69 are formed in this shutter guide member 71 with positions and sizes coinciding with the bases of the compartments 67 (see FIG. 9C).

Figure 12A:
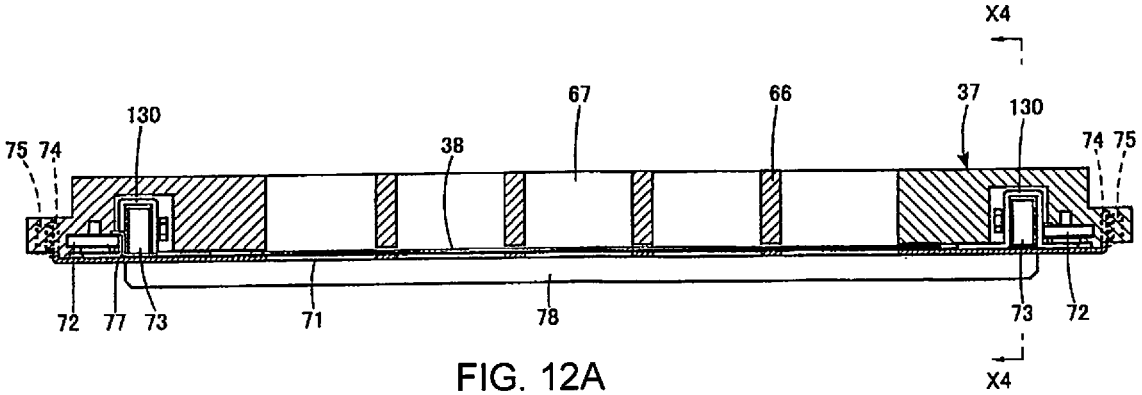
FIG. 12A is a cross-sectional view of the carrier portion.

Guide rollers 72 supported on the vertical axis with constant spacing in the cross direction (see FIG. 12A) are disposed at a plurality of locations along the movement direction of the shutter 38 on both the left and right side edges of the shutter guide member 71. On the back end of the shutter guide member 71, a foreign matter discharge slit 80 is formed with a length reaching the vicinities of the edges on both sides in the horizontal direction at a position corresponding to the brush 68 provided on the carrier 37 (see FIG. 9C).

Figure 9C:
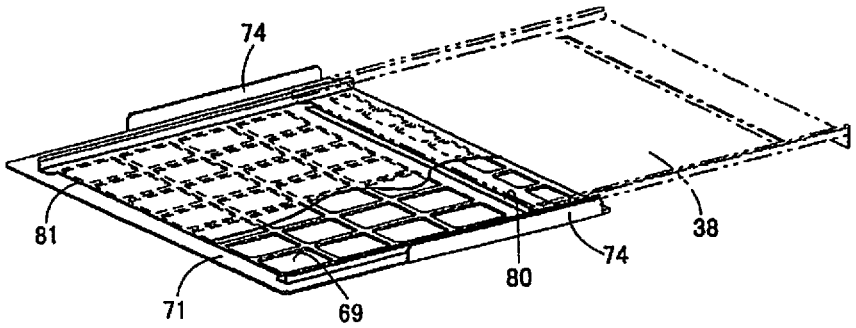
FIG. 9C is a partially cut out perspective view of a state in which the carrier is omitted.
Figure 12B:
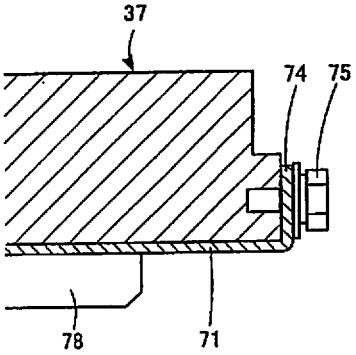
FIG. 12B is an enlarged cross-sectional view of the junction portion of the carrier and the shutter guide member.

Connecting edges 74, which are bent upward, are provided on both the left and right side edges of the shutter guide member 71, and the connecting edges 74 are disposed along both side surfaces of the carrier 37 (see FIGS. 9A to 9C). The connecting edges 74 are fixed to the carrier with fixing screws 75 (see FIGS. 12A and 12B) so that the carrier 37 and the shutter guide member 71 are formed integrally.

The shutter 38 is formed from a single stainless steel plate roughly equal to the width in the horizontal direction and the length in the cross direction of the frame 65 of the carrier 37. As shown in FIG. 9B, guide edges 77 which are bent upward are formed on both the left and right sides, and an engaging edge 78, which is bent downward, is formed on the back end. On the inside of the engaging edge 78 is provided a foreign matter discharge slit 79 parallel to the engaging edge 78 with a length extending to the vicinities of the left and right guide edges 77. A shallow letter-shaped notch part 81 with the same length as the slit 79 (see FIG. 9C) is provided on the front end edge.

The shutter 38 is inserted into the gap between the carrier 37 and the shutter guide member 71 from an insertion port 82 on the back end side of the carrier 37 (see FIGS. 11A to 11C) so as to slide freely in the cross direction, and the base and both the left and right side edges are guided by the shutter guide member 71. The left and right guide edges 77 are guided by the guide rollers 72 of the shutter guide member 71 (see FIG. 12A).

Figure 11A:
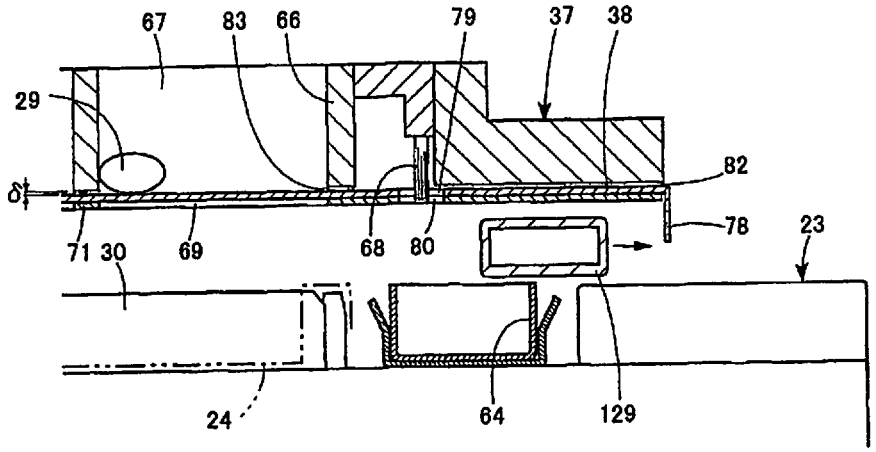
FIG. 11A is a cross-sectional view of the foreign matter discharge portion of the carrier.
Figure 11B:
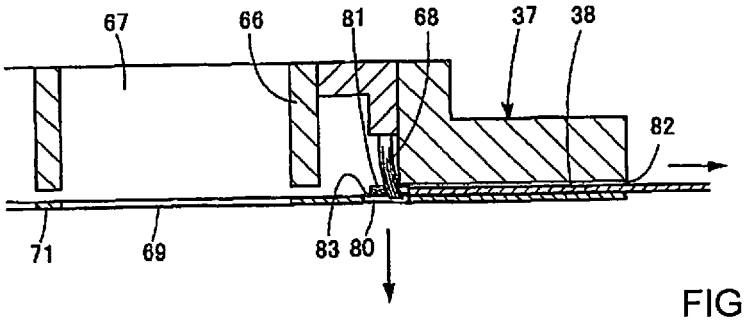
FIG. 11B is a cross-sectional view of the carrier at the time of foreign matter discharge.
Figure 11C:
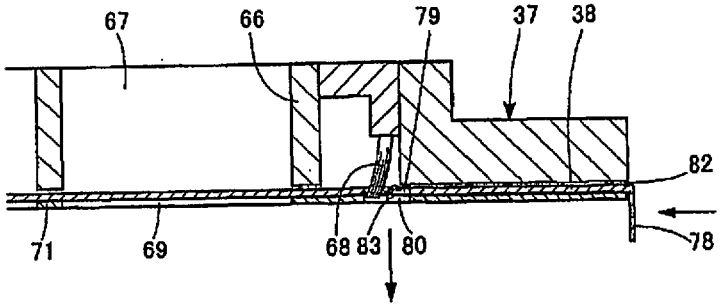
FIG. 11C is a cross-sectional view of the carrier in another state at the time of foreign matter discharge.

When the shutter 38 is inserted most deeply, [the shutter 38] overlaps with the entire surface of the base of the carrier 37 so as to close the bases of all of the compartments 67 (see FIG. 11A). At that time, the shutter 38 is set so that it does not stick to the base of the carrier 37 and so that there is a gap δ of a size which prevents the passage of tablets 29, but allows the passage of foreign matter 83 smaller than a certain size, such as small chips of tablets 29.

When the shutter 38 is in the fully closed state, the foreign matter discharge slit 79 coincides with the upper surface of the slit 80 of the shutter guide member 71.

When the shutter 38 is pulled out (see FIG. 11B), the bases of the compartments 67 of the carrier 37 and the square holes 69 of the shutter guide member 71 are opened, and the tablets 29 in the compartments 67 are discharged into the tray 24. The brush 68 makes contact with the upper surface of the shutter 38 during the movement of the shutter 38, and the foreign matter 83 passing through the gap δ of the compartments 67 of the carrier 37 is captured by the brush 68. When the shutter 38 reaches the fully opened state, the notch part 81 coincides with the slit 80 of the shutter guide member 71 so that foreign matter is discharged into the foreign matter reception tray 64 installed below the shutter 38.

Conversely, when the shutter 38 is closed from the fully opened state to the fully closed state, the foreign matter 83 on the upper surface of the shutter 38 is similarly captured by the brush 68 (see FIG. 11C), and when the slit 79 of the shutter 38 coincides with the slit 80 of the shutter guide member 71, the foreign matter 83 is discharged into the foreign matter reception tray 64 in the same manner as described above.

As described below, the carrier 37 is connected to the drive device 39 via a gate-shaped bracket 70 (see FIG. 9A) so as to be formed integrally with the shutter 38 and the shutter guide member 71 and driven by the drive device 39; and the carrier 37 is controlled so as to execute one cycle of the carrying process for each tray 24 within the horizontal plane of the packaging part 14.

As shown in FIG. 8, in one cycle of the carrying process, the position in which the carrier 37 is located above the standby position b of the mounting platform 30 is defined as the original position. At this original position, the carrier 37 is in a position for discharging tablets 29 into the tray 24 on the mounting platform 30, and this position is called the discharge position A. In one cycle of the carrier 37, a process is executed in which the carrier 37 sequentially moves from the discharge position A serving as the original position to a reception starting position B where the reception of tablets 29 is started below the discharge port 21 of the tablets 29 and a reception ending position C, where the reception of the tablets 29 is completed and then returns to the discharge position A serving as the original position.

At the discharge position A, all of the compartments 67 of the carrier 37 coincide with the positions of all of the storage concavities 26 of the tray 24 on the mounting platform 30 in the standby position b. The contents of the compartments 67 are empty when the carrying cycle is initially started, and the shutter 38 is in the closed state.

The following such reception process is executed while moving from the reception starting position B to the reception ending position C during the carrying processing described above. Specifically, at the reception starting position B, the carrier 37 is positioned so that the compartment 67 of (1, 1) (see FIG. 8B) is located below the discharge port 21.

Using this position as a starting point, the respective compartments 67 are sequentially moved below the discharge port 21 to receive tablets in coincidence with the timing with which one dose of the tablets 29 is discharged from the discharge port 21. Reception begins from the compartment 67 of (1, 1) and then proceeds to (1, 2), (1, 3), . . . as shown by the arrows in FIG. 8B so as to receive four doses per row (four doses for Monday). This is then repeated for (2, 1), (2, 2), . . . to ultimately reach (7, 4). The position of the carrier 37 when the carrier 37 reaches the final position (7, 4) is the reception ending position C. The carrier 37 returns from the reception ending position C to the discharge position A so as to complete one cycle of the carrying process.

When the cycle described above ends, the shutter 38 is opened by the opening/closing device 40 (see FIG. 5), and the tablets 29 in each of the compartments 67 are discharged into all of the corresponding storage concavities 26 of the tray 24 in the standby position b.

When the discharge of the tablets 29 is complete and the shutter 38 is closed, the next cycle of the carrying process is begun. Meanwhile, the drawer 23 is pulled out and the tray 24 is replaced at the tray handling position a. The drawer 23 is then pushed back in, and the next tray 24 is moved to the standby position b, where it comes to rest.

In the drive device 39 (see FIG. 5) of the carrier 37 which executes the carrying cycle described above, an XY drive mechanism is formed by a Y-direction drive motor 84, an X-direction drive motor 85, Y-direction drive belts 86 which are installed at two locations on the left and right sides of the packaging part 14 and are interlocked by an interlocking shaft 90 in the X-direction, a casing 87 which spans between and is fixed to the two Y-direction drive belts 86, and an X-direction drive belt 88 provided inside the casing 87. The X-direction drive motor 85 is fixed to the casing 87.

Figure 13:
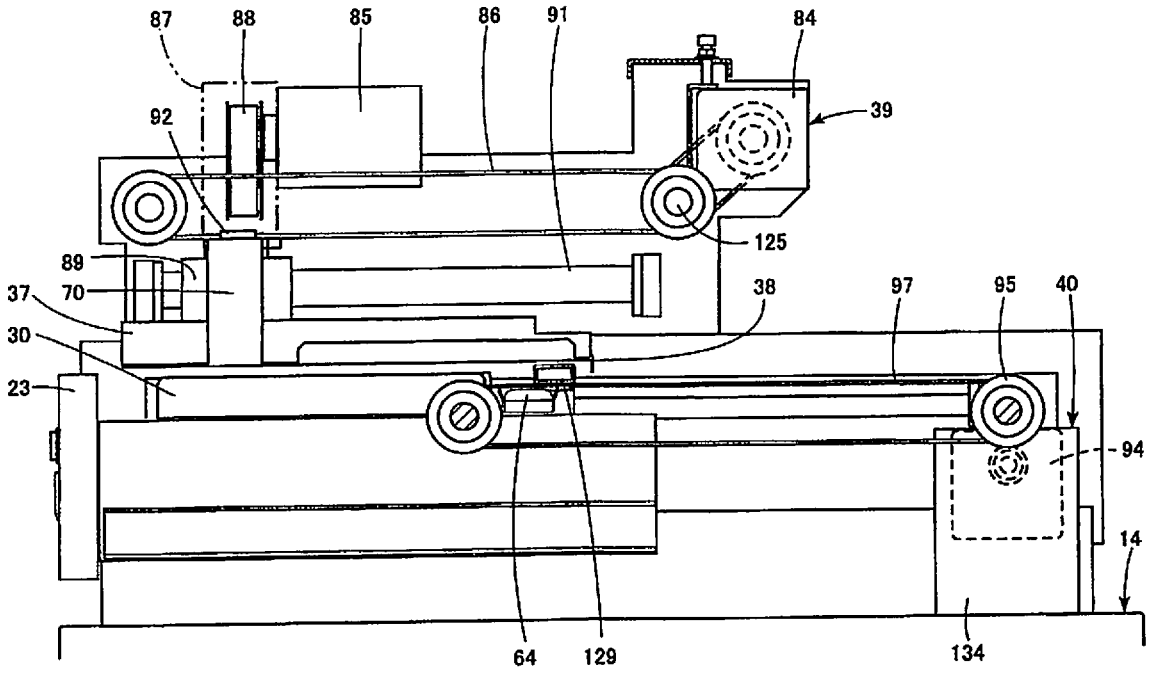
FIG. 13 is a partially omitted enlarged cross-sectional view along X5-X5 in FIG. 5.

More specifically, as shown in FIG. 13, a Y-direction slider 89 linked to the Y-direction drive belt 86 is made to slidably engage with a Y-direction guide bar 91 disposed along the belt 86. This Y-direction slider 89 and the casing 87 are linked via a bracket 92 (see FIG. 14).

Figure 14:
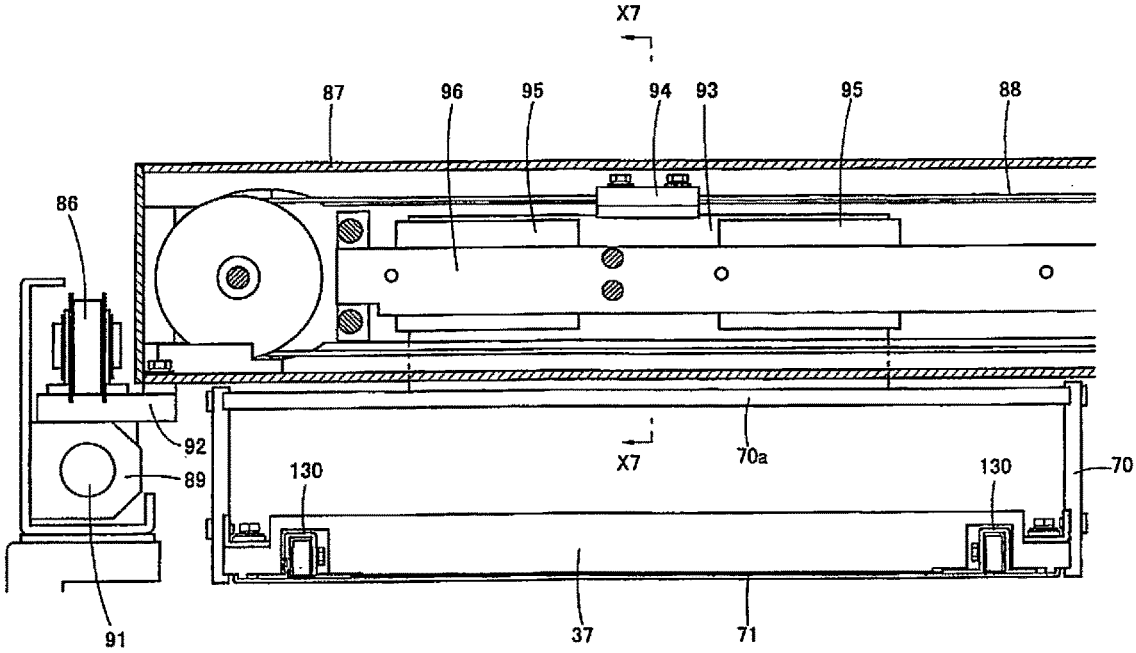
FIG. 14 is a partially omitted enlarged cross-sectional view along line X6-X6 in FIG. 5.
Figure 15:
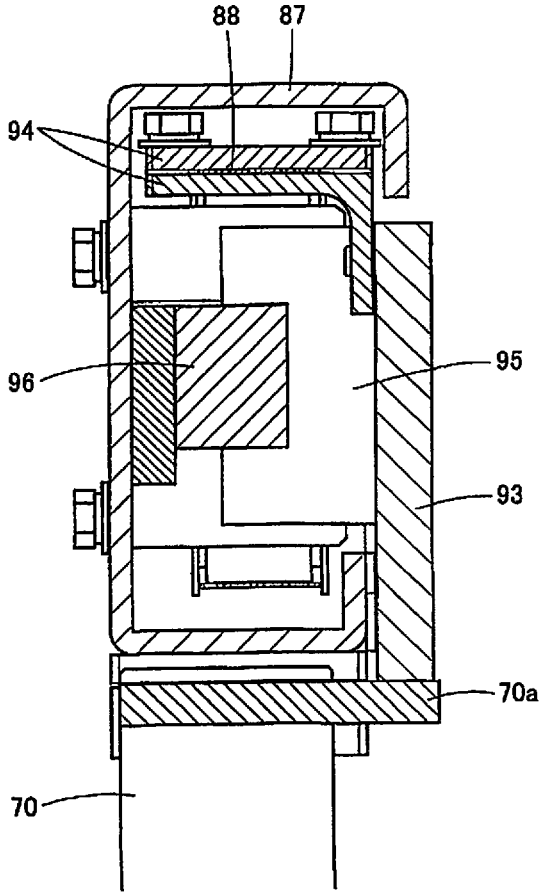
FIG. 15 is a partially omitted enlarged cross-sectional view along line X7-X7 in FIG. 14.

As shown in FIGS. 14 and 15, a belt holding member 94 is attached to the X-direction drive belt 88, and a slider holder 93 is fixed to the belt holding member 94. Two X-direction sliders 95 are provided on the slider holder 93, and each X-direction slider 95 is made to slidably engage with the X-direction guide bar 96 provided on the casing 87. The upper bar 70*a* of the gate-shaped bracket 70 is connected to the slider holder 93. As a result, the carrier 37 is connected to and interlocked with the X-direction drive belt 88 via the bracket 70, the slider holder 93, the X-direction sliders 95, and the belt holding member 94.

The Y-direction drive motor 84 and the X-direction drive motor 85 consist of stepping motors and are drive-based on drive signals in the Y-direction and the X-direction from a control device (not shown). When the Y-direction drive belts 86 are driven in response to this driving, the casing 87 and the carrier 37 mounted on the casing 87 are moved by a prescribed amount in the Y-direction. When the X-direction drive belt 88 is driven by the X-direction drive motor 85, the carrier 37 linked to the X-direction drive belt 88 is driven in the X-direction. In this way, the carrier 37 executes the cycle of the carrying process described above.

It may be necessary to remove the carrier 37 from the packaging part 14 due to the need for cleaning or the like.

Figure 10A:
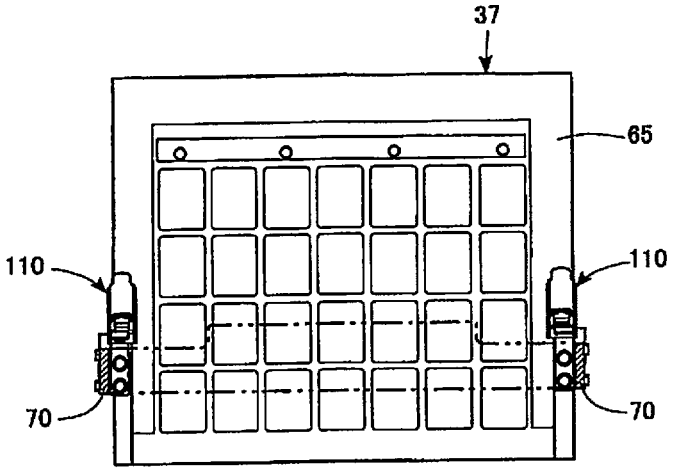
FIG. 10A is a transverse plan view of the carrier portion.
Figure 10B:
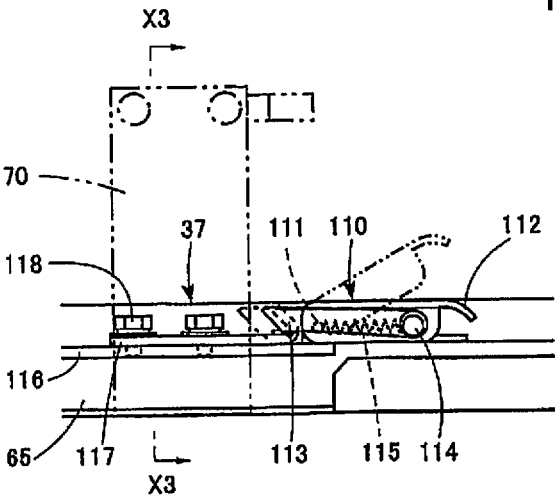
FIG. 10B is an enlarged side view showing part of FIG. 10A.

Therefore, the carrier 37 is detachably connected to the bracket 70 and is ordinarily connected in an inseparable state by locking members 110 (see FIGS. 10A and 10B).

That is, as shown in FIGS. 10A and 10B, locking members 110 are respectively fixed to the frame 65 on the left and right sides of the carrier 37. The locking members 110 are buckles (so-called catch locks), wherein a hook 113 is connected by a shaft 114 to a lever 112 attached to a fixed shaft 111, and the hook 113 is biased in the tip direction by an internal spring 115.

Figure 10C:
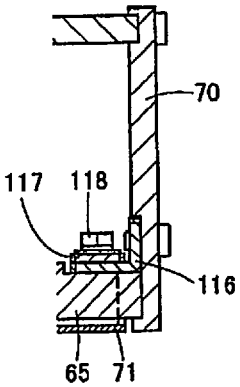
FIG. 10C is a cross-sectional view along line X3-X3 in FIG. B.

On the other hand, an L-shaped fitting 116 fixed to the inside of the gate-shaped bracket 70 extends to the upper surface of the frame 65 of the carrier 37 and makes contact with the upper surface thereof (see FIGS. 10B and 10C). An engaging member 117 is fixed to the L-shaped fitting 116 by a fixing screw 118, and the tip is made to engage with the hook 113 of each locking member 110. The carrier 37 is connected to the bracket 70 by the engagement of the hooks 113.

When the lever 112 of the locking member 110 is pulled up, the hook 113 advances forward (see the double-dotted/dashed line) and is disengaged from the tip of the engaging member 117. As a result, the carrier 37 is released from the bracket 70, which makes it possible to remove the carrier 37 to the outside of the packaging part 14 for cleaning or the like.

Next, the opening/closing device 40 of the shutter 38 (see FIG. 5) consists of a mechanism related to the opening of the shutter 38—that is, an opening mechanism—and a closing mechanism related to the closing thereof.

The opening mechanism comprises a shutter opening/closing motor 123 installed behind the packaging part 14 shown in FIG. 5, an interlocking shaft 125 in the X-direction driven by the motor 123 via a gear 124, shutter opening/closing belts 126 which are installed in the Y-direction on both the left and right sides of the packaging part 14 and are driven by the interlocking shaft 125, guide bars 127 disposed along both of the shutter opening/closing belts 126, sliders 128 which are linked to the shutter opening/closing belts 126 and are made to slidably engage with the guide bars 127, and an engaging bar 129 spanning between the left and right sliders 128.

The shutter opening/closing motor 123 is supported by a supporting member 134 (see FIGS. 5 and 13).

The engaging bar 129 is disposed on the front side of the engaging edge 78 of the shutter 38 (see FIG. 11A) and is made to engage with the front surface of the engaging edge 78 when the engaging bar 129 moves backward so as to move as a unit, whereby the shutter 38 is opened.

Figure 12C:
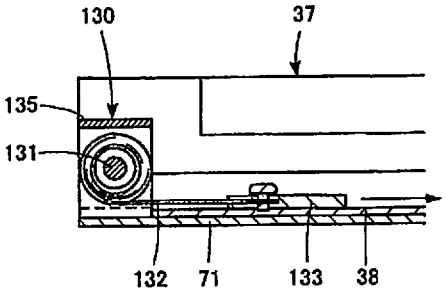
FIG. 12C is an enlarged cross-sectional view along line X4-X4 in FIG. 12.

The opening mechanism described above exclusively performs the operation of opening the shutter 38, and the closing function is performed by the closing mechanism. That is, as shown in FIG. 12C, the closing mechanism is provided with a wound spring device 130 exhibiting a spring force in the winding direction on the shutter guide member 71. A band spring 132 wound into a compressed state by a shaft 131 is supported inside a spring case 135 constituting the spring device 130. The free end of the band spring 132 is connected to part of the shutter 38 in the closed state via a fixed coupling member 133. When the shutter 38 is in the closed state, the band spring 132 is in the compressed state.

When the shutter 38 is opened, the band spring 132 exhibits a spring force in the closing direction and is pulled in response to the opening. Next, when the engaging bar 129 returns to the original position, the band spring 132 is compressed to the wound state by the spring force and simultaneously closes the shutter 38. By using a product incorporating a fixed-load spring (commercially available under the brand name "Conston" (registered trademark) as the band spring 132, the problem of the shutter 38 being closed traumatically can be avoided.

As described above, the opening/closing device 40 of the shutter 38 executes an opening/closing process of constantly maintaining the shutter 38 in the closed state in coincidence with the timing of the movement of the carrier 37 and opening the shutter after the carrier 37 returns to the discharge position A from the reception ending position C. When the engaging bar 129 is moved to the original position by operating the shutter opening/closing motor 123 in reverse after the tablets 29 are discharged into the tray 24 in the discharge position A, the shutter 38 returns to the closed position as a result of the spring force of the band spring 132.

Next, the measures taken in the event that an error occurs in the reception of the tablets 29 and the tablets 29 are not accurately dispensed into the compartments 67 of the carrier 37 will be described.

After returning to the discharge position A, a check is performed by an optical or visual examination as to whether the tablets have been accurately dispensed into the respective compartments 67. As a result, if a dispensing error is discovered, the shutter 38 is not opened, and the carrier 37 is moved to a recovery position D (see FIG. 8A) established to the right of the packaging part 14 by the drive device 39.

Figure 16A:
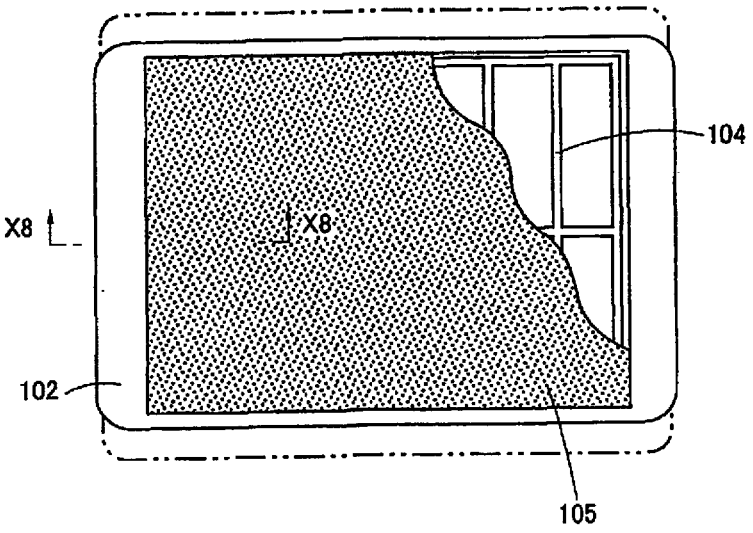
FIG. 16A is a partially cut out plan view of the recovery tray.
Figure 16B:
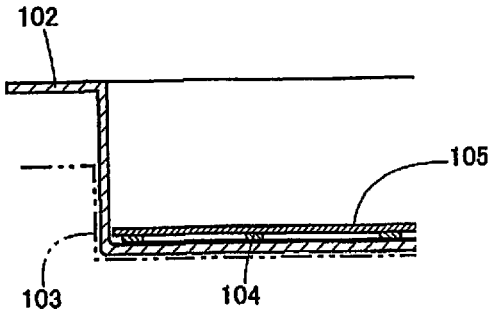
FIG. 16B is an enlarged cross-sectional view along line X8-X8 in FIG. 16A.

A recovery tray 102 is installed at the recovery position D in advance (see FIG. 16A), and the shutter 38 is opened at the point when the carrier 37 reaches the recovery tray 102 so as to discharge all of the tablets 29 in the carrier 37 into the recovery tray 102. The carrier 37 then temporarily returns to the discharge position A and proceeds to perform the normal carrying process thereafter.

A tray reception concavity 103 is provided at the recovery position D, and the recovery tray 102 is detachably installed on the tray reception concavity 103. In order to prevent the ricocheting of the discharged tablets 29, a grid-like base plate 104 is laid out over the inside base of the recovery tray 102, and a cushion sheet 105 made of a resin is laid out over the base plate 104. The base plate 104 provides a gap between the inside base of the recovery tray 102 and the cushion sheet 105 and enhances the elasticity of the cushion sheet 105.

The tablet packaging device 11 of this embodiment is configured as described above, and a series of tablet packaging operations using this device will be described next.

The operator performing the packaging operations pulls out the drawer 23, places the tray 24 on the mounting platform 30 at the tray handling position a, pushes the drawer 23 back in, and then brings the mounting platform 30 to rest at the standby position b. At this point, the cam followers 46 of the vertical moving device 41 of the mounting platform 30 remain at rest at the lowest position. Accordingly, there is a sufficient gap x between the tray 24 on the mounting platform 30 and the carrier 37 above the tray 24, so the movement of the carrier 37 is never inhibited. The mounting platform 30 stays at the standby position b until the discharge of the tablets 29 is received.

When the mounting platform 30 is at rest at the standby position b, the drive device 39 of the carrier 37 is driven so that the carrying process is started. The carrier 37 transitions from the discharge position A to the reception starting position B, and once this transition has been confirmed, prescribed tablets 29 are discharged from the tablet feeder 17. The drive device 39 sequentially moves the carrier 37 from the reception starting position B to the reception ending position C in coincidence with the timing with which the tablets are intermittently discharged from the discharge port 21 and then executes the reception process for receiving the tablets 29 into the respective compartments 67.

When the carrier 37 reaches the reception ending position C, the carrier 37 then returns to the discharge position A, and the carrying process is thereby completed. Once the carrier 37 returns to the discharge position A, it is checked as to whether the tablets 29 have been accurately dispensed into the respective compartments 67, and if it is assessed that the dispensing is inaccurate, the carrier 37 is moved to the recovery position D. At the recovery position D, the shutter 38 is opened so as to discharge all of the tablets 29 into the recovery tray 102.

If it is assessed as a result of this check that the respective compartments 67 contain the correct tablets 29, the vertical moving device 41 is activated, and the mounting platform 30 is moved upward so as to press the tray 24 resting on the mounting platform 30 into the base of the carrier 37.

Next, when the opening/closing device 40 of the shutter 38 is driven so that the engaging bar 129 moves backward, the shutter 38 engaged with the engaging bar 129 also moves backward together with the engaging bar 129. As a result, the compartments 67 of the carrier 37 are opened, and the tablets 29 inside the compartments 67 are discharged into the storage concavities 26 of the tray 24. When the shutter 38 is fully opened, all of the compartments 67 are opened, and the tablets 29 are stored in all of the storage concavities 26. The shutter 38 is then closed by the action of the band spring 132.

Next, the vertical moving device 41 of the drawer 23 is driven so as to move the mounting platform 30 downward, and the drawer 23 is pulled out after a gap x is created between the tray 24 and the carrier 37. The tray 24 is removed from the mounting platform 30 pulled out to the tray handling position a, and the tray 24 is sent to the following packaging process. In the packaging process, the lid sheet 25 is attached to the open surface of the tray 24, and the packaging operations of the tablets 29 are thereby completed.

The tablet packaging device described above is provided with a monitor for displaying the tablet dispensing status. The dispensing of tablets into the tray 24 may be performed automatically, as described above, and medicines which cannot be stored in the table storage part 13 may also be secondarily dispensed manually in the form of so-called manual dispensing. Examples of the display screen in the case of manual dispensing are shown in FIGS. 17 to 22.

Figure 17:
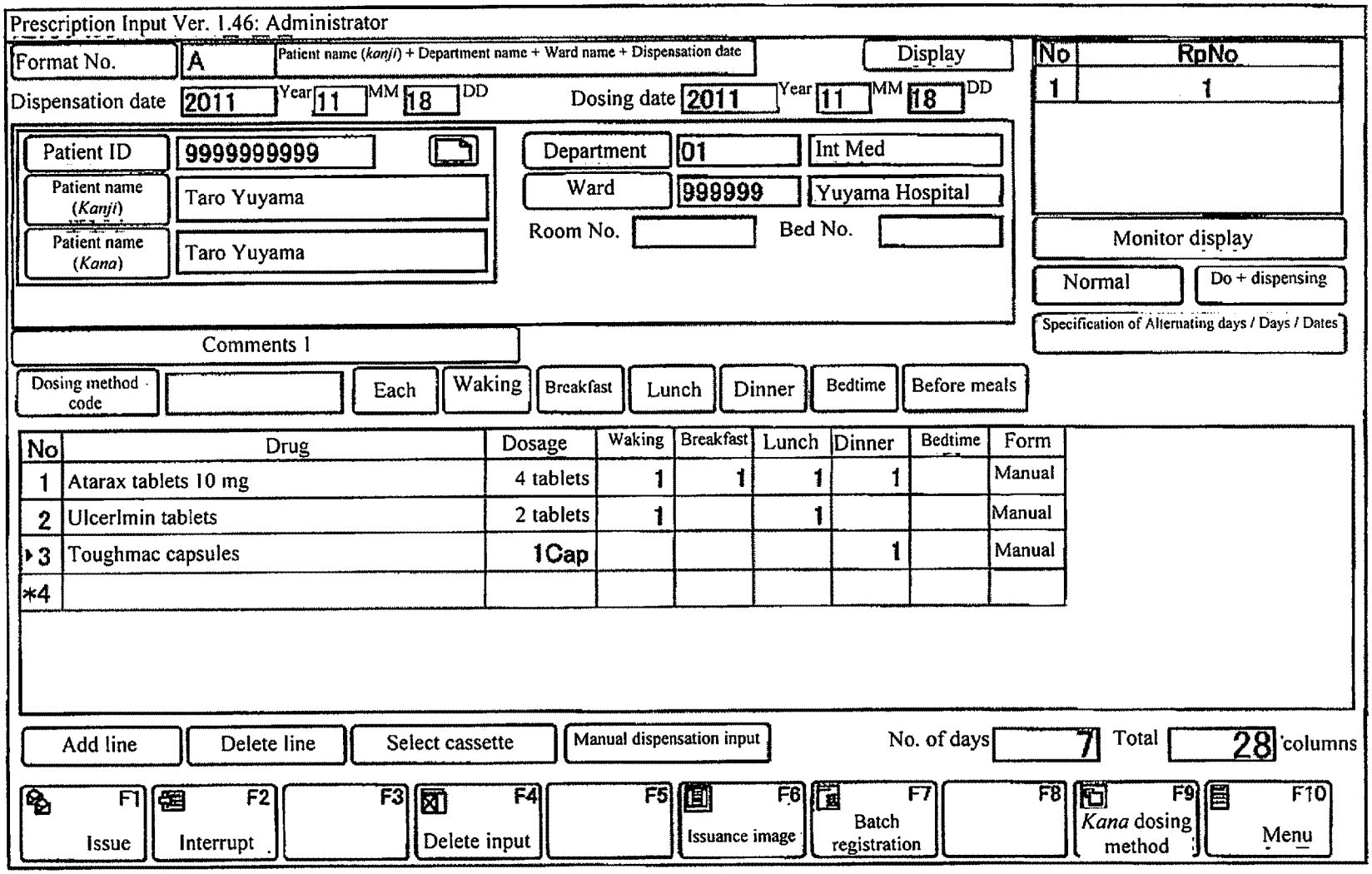
FIG. 17 is a front view showing an example of the display screen for prescription input at the time of manual dispensing.
Figure 18:
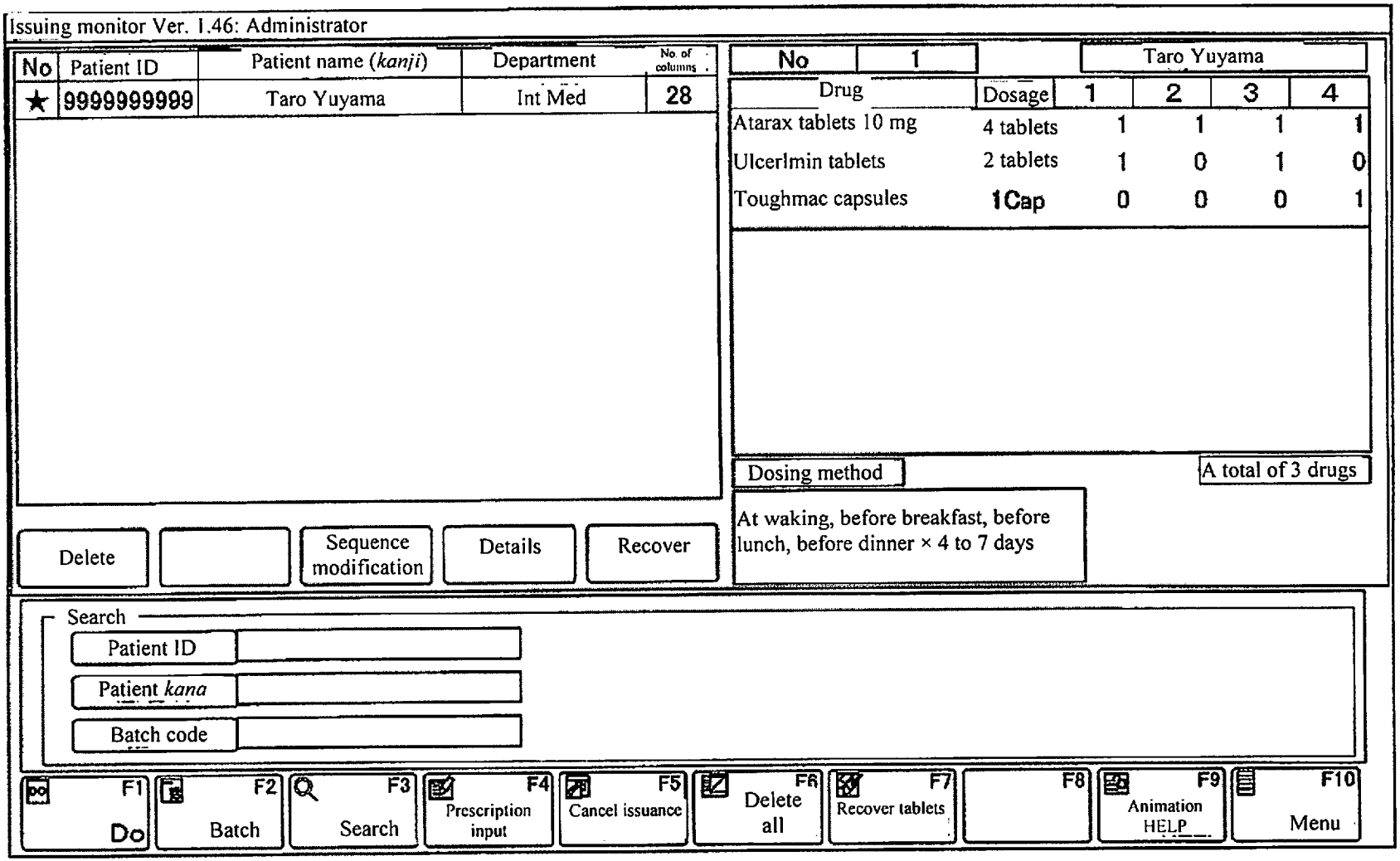
FIG. 18 is a front view showing an example of the discharge monitor display screen at the time of manual dispensing.
Figure 19:
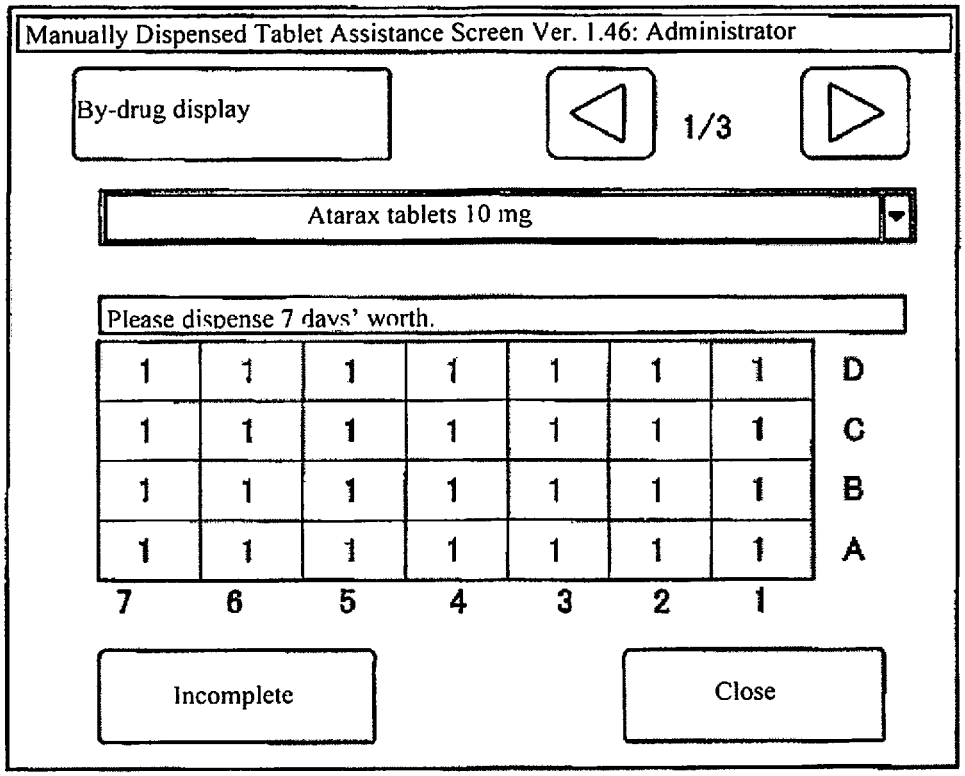
FIG. 19 is a front view showing part 1 of the manual tablet dispensing assistance screen.
Figure 20:
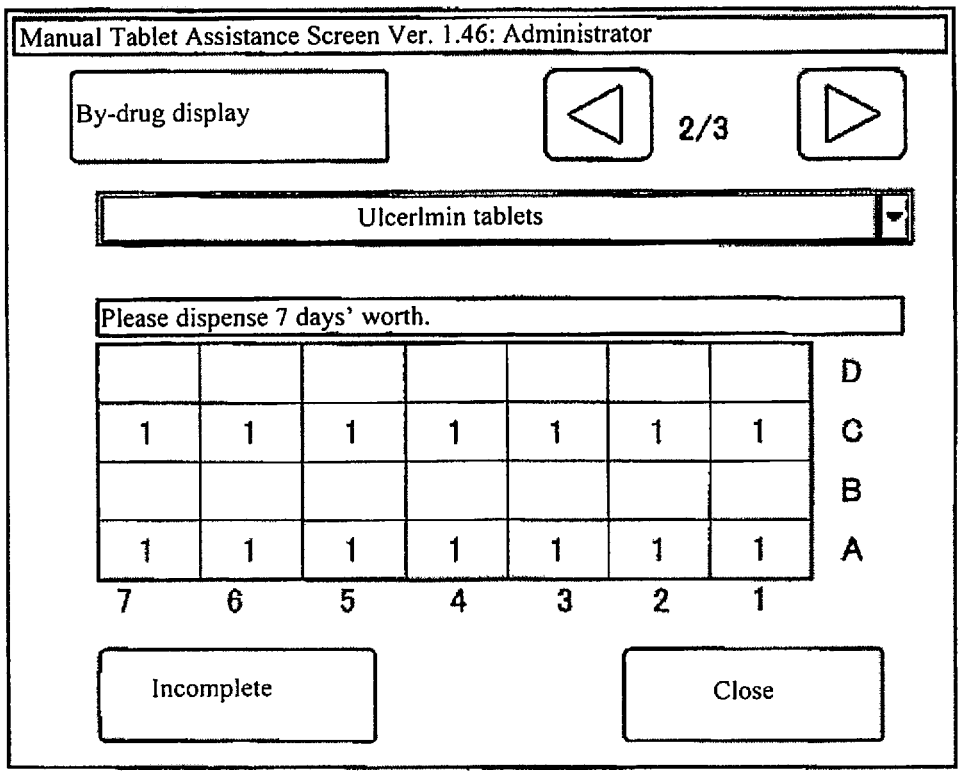
FIG. 20 is a front view showing part 2 of the manual tablet dispensing assistance screen.
Figure 21:
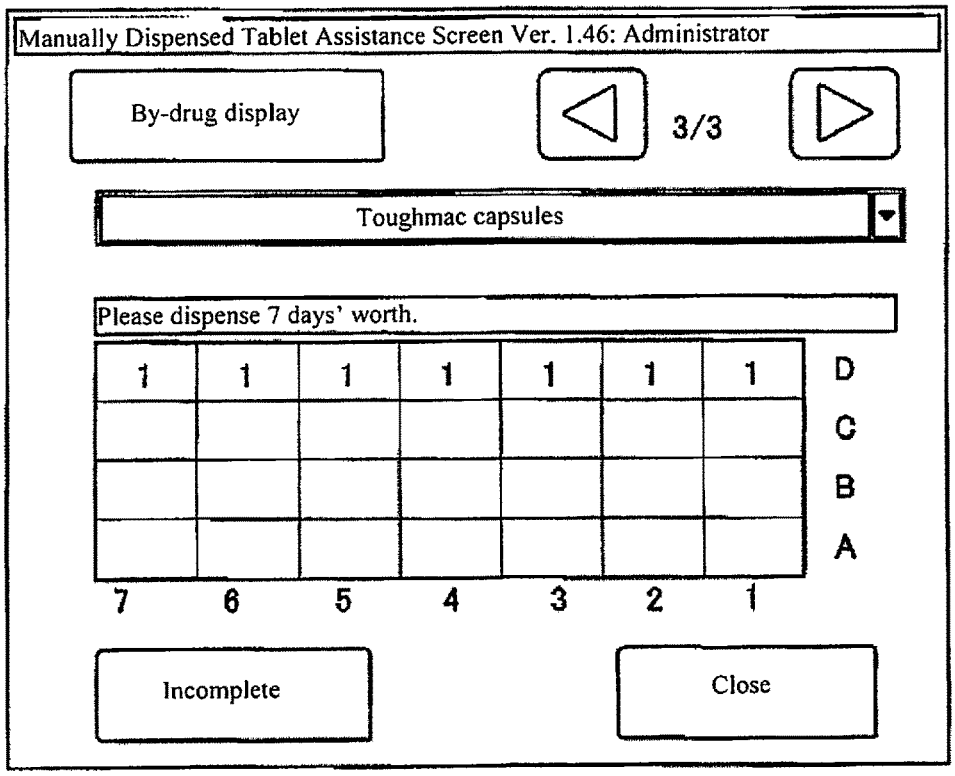
FIG. 21 is a front view showing part 3 of the manual tablet dispensing assistance screen.

FIG. 17 is a prescription input display screen, wherein the number of tablets or the like for each dosing period of the medicine prescribed to the patient is displayed. FIG. 18 is a discharge monitor display screen which enables the confirmation of the medicine presently being discharged. FIGS. 19 to 21 are display screens of the dispensing positions and the numbers of tablets in each of the storage concavities 26 of the tray 24 for each tablet, and the dispensing position and quantity of the next medicine or the previous medicine can be confirmed by following the arrows on the screen.

Figure 22:
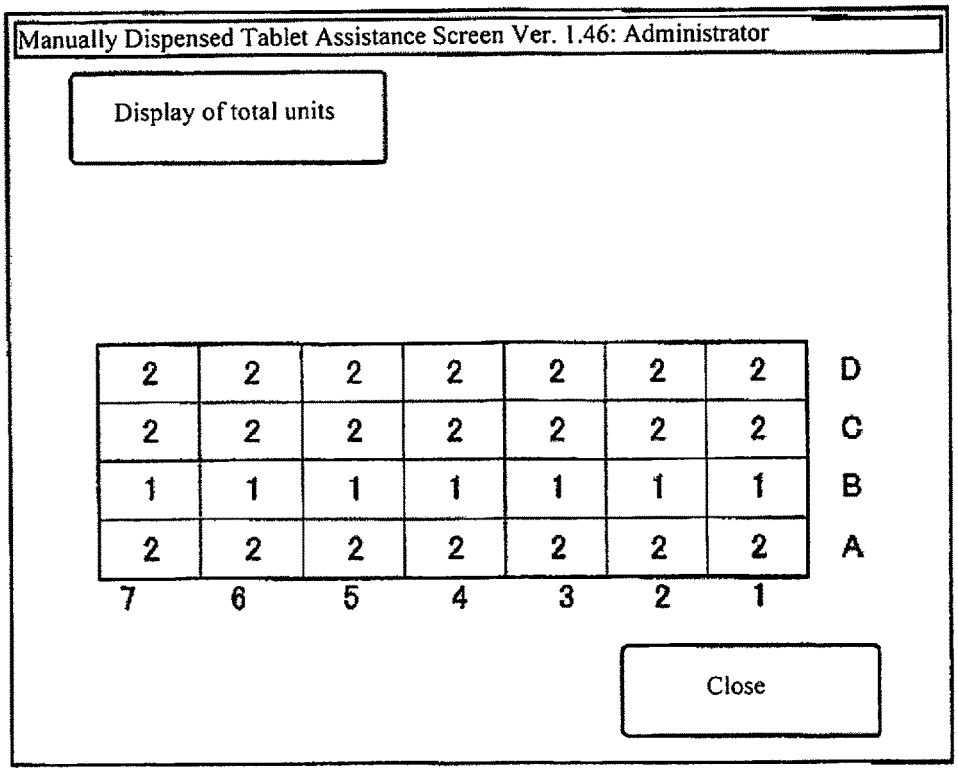
FIG. 22 is a front view showing part 4 of the manual tablet dispensing assistance screen.

FIG. 22 is a display screen of the total number of tablets in each of the storage concavities 26, which makes it possible to confirm whether there are any errors in the numbers of tablets ultimately dispensed into each of the storage concavities 26. The tablet dispensing status in the case of manual dispensing can be confirmed based on these display screens.

EXPLANATION OF REFERENCES a tray handling position
b standby position
A discharge position
B reception starting position
C reception ending position
D recovery position
11 tablet packaging device
12 frame
13 tablet storage part
14 packaging part
15 storage part
16 tablet cassette
17 tablet feeder
18 slatted shutter
19 discharge chute
20 reception port
21 discharge port
22 cover lid
23 drawer
24 tray
25 lid sheet
26 storage concavity
27*a* side wall
27*b* side wall
27*c* dividing wall
27*d* groove
28 crease
29 tablet
30 mounting platform
30*a* tray support ribs
31 adhesive
31*a* break line
31*b* breakout part
32 day-of-the-week display
33 date display
34 dosing time display
35 prescription display
37 carrier
38 shutter
39 drive device
40 opening/closing device
41 vertical moving device
42 vertical movement motor
43 belt
44 rotary shaft
45 eccentric cam
46 cam follower
47 bearing
48 fixed bracket plate
49 movable bracket plate
51 long hole
52 fixing screw
53, 54 adjustment plates
55, 56 adjustment bolts
57 mounting platform supporting member
58 guide pin
59 contact plate
60 coil spring
61 sleeve
62 anti-slip member
64 foreign matter reception tray
65 frame
66 dividing wall
67 compartment
68 brush
69 square hole
70 bracket
70*a* upper bar
71 shutter guide member

72 guide roller
74 connecting edge
75 fixing screw
77 guide edge
78 engaging edge
79 slit
80 slit
81 notch part
82 insertion port
83 foreign matter
84 Y-direction drive motor
85 X-direction drive motor
86 Y-direction drive belt
87 casing
88 X-direction drive belt
89 Y-direction slider
90 interlocking shaft
91 Y-direction guide bar
92 bracket
93 slider holder
94 belt holding member
95 X-direction slider
96 X-direction guide bar
102 recovery tray
103 tray reception concavity
104 base plate
105 cushion sheet
110 locking member
111 fixed shaft
112 lever
113 hook
114 shaft
115 internal spring
116 L-shaped fitting
117 engaging member
118 fixing screw
123 shutter opening/closing motor
124 gear
125 interlocking shaft
126 shutter opening/closing belt
127 guide bar
128 slider
129 engaging bar
130 spring device
131 shaft
132 band spring
133 fixed coupling member
134 supporting member
135 spring case

The invention claimed is:

1. A tablet packaging device comprising:

a packaging part provided below a discharge opening for tablets discharged in accordance with a prescription; and a tray having a prescribed number of storage concavities divided into a plurality of rows and columns placed on the packaging part, the respective storage concavities being configured to store tablets discharged from the discharge opening;

wherein the packaging part comprises a mounting platform for the tray and a moving device for the mounting platform, a carrier provided with compartments opened at a top and a bottom which selectively coincide with positions of the storage concavities of the tray and a drive device for the carrier, and a shutter provided on the bottom of the carrier so as to open and close the compartments and an opening/closing device for the shutter; and wherein the moving device of the mounting platform comprises a drawer provided so as to be freely drawn into and out of the packaging part, said mounting platform being installed inside the drawer; and the mounting platform is set so as to be in a tray handling position outside the packaging part when the drawer is pulled out and in a standby position inside the packaging part when the drawer is pushed in, wherein the drive device is configured to execute a process stored in a memory associated with a computer, which when executed, assesses whether the tablets have been accurately dispensed into identified compartments, wherein if it has been assessed that the tablets have been inaccurately dispensed, the carrier executes a recovery operation.

2. The tablet packaging device of claim 1, wherein the opening/closing device of the shutter executes a process of opening the shutter to store the tablets received by the carrier in the respective storage concavities which are in the standby position.

3. The tablet packaging device of claim 1, further comprising a monitor configured to display a representation of the tray including a number of tablets in each of the storage concavities of the tray.

4. The tablet packaging device of claim 1, wherein the carrier is selectively removable from the packaging part.

5. The tablet packaging device of claim 1, wherein if it has been assessed that the tablets have been inaccurately dispensed, the process causes the opening/closing device of the shutter to open the shutter and discharge all of the tablets into a recovery tray.

6. The tablet packaging device of claim 1, wherein the drive device executes a process stored in a memory associated with a computer, which when executed, assesses whether the tablets have been accurately dispensed into identified compartments, wherein if it has been assessed that that the tablets have been accurately dispensed, the process causes a vertical moving device to activate and move the mounting platform in an upward direction to press the tray into the bottom of the carrier.

7. The tablet packaging device of claim 6, wherein the drawer is configured to be pulled out from the moving device if it has been assessed that the tablets have been accurately dispensed.

* * * * *